US008133066B2

(12) United States Patent
Beak et al.

(10) Patent No.: US 8,133,066 B2
(45) Date of Patent: Mar. 13, 2012

(54) CONNECTOR APPARATUS AND RECEIVING CONNECTOR OF THE CONNECTOR APPARATUS

(75) Inventors: Seung Seok Beak, Shinagawa (JP); Koichi Kiryu, Shimotaki-gun (JP); Keiichi Hirose, Minato-ku (JP); Tomonori Iino, Minato-ku (JP)

(73) Assignees: Fujitsu Component Limited, Tokyo (JP); NIT Facilities, Inc., Tokyo (JP)

( * ) Notice: Subject to any disclaimer, the term of this patent is extended or adjusted under 35 U.S.C. 154(b) by 0 days.

(21) Appl. No.: 12/842,241

(22) Filed: Jul. 23, 2010

(65) Prior Publication Data

US 2011/0117759 A1 May 19, 2011

(30) Foreign Application Priority Data

Nov. 13, 2009 (JP) ..... 2009-259775

(51) Int. Cl.
*H01R 29/00* (2006.01)

(52) U.S. Cl. ..... 439/188

(58) Field of Classification Search ..... 439/92, 439/38, 188; 200/51 R, 51.09, 51.11, 51.12
See application file for complete search history.

(56) References Cited

U.S. PATENT DOCUMENTS

| | | | | |
|---|---|---|---|---|
| 2010/0029110 | A1 * | 2/2010 | Kiryu et al. | 439/188 |
| 2010/0029111 | A1 * | 2/2010 | Yuba et al. | 439/188 |

FOREIGN PATENT DOCUMENTS

| | | | |
|---|---|---|---|
| EP | 2149939 | * | 2/2010 |
| EP | 2149940 | * | 2/2010 |
| EP | 2149941 | * | 2/2010 |
| JP | 05-82208 | | 4/1993 |
| JP | 2003-31301 | | 1/2003 |
| JP | 2010-56055 | * | 3/2010 |
| JP | 2010-56056 | * | 3/2010 |
| JP | 2010-118173 | * | 5/2010 |

* cited by examiner

*Primary Examiner* — Javaid Nasri
(74) *Attorney, Agent, or Firm* — Ipusa, PLLC

(57) ABSTRACT

A connector apparatus includes a receiving connector connected to a power source and including first and second power jack terminals, a control jack terminal, a control switch including first and second contact points, and an insulative spring positioned below the control switch, and an inserting connector connected to an electronic device and including first and second power plug terminals connected in correspondence with the first and second power jack terminals for receiving power from the power source, and a control plug terminal that extends towards the control switch and applies pressure to the insulative spring for causing the first and second contact points to connect and enabling the power from the power source to be supplied to the electronic device. A part of the insulative spring is configured to melt when an electric arc is generated by disconnecting the connection between the first and second contact points.

15 Claims, 23 Drawing Sheets

CONNECTOR APPARATUS AND RECEIVING CONNECTOR OF THE CONNECTOR APPARATUS

BACKGROUND OF THE INVENTION

1. Field of the Invention

The present invention generally relates to a connector apparatus and a receiving connector of the connector apparatus, and more particularly to a connector apparatus and a receiving connector of the connector apparatus for supplying electric power.

2. Description of the Related Art

Generally, an electric device operates by receiving power supplied from a power source. Typically, the electric device receives the power supply from the power source via a connector apparatus. As disclosed in Japanese Laid-Open Patent Publication Nos. 5-82208 and 2003-31301, the connector apparatus achieves electric connection by engaging a male connector (hereinafter also referred to as "inserting connector") and a female connector (hereinafter also referred to as "receiving connector").

In recent years, as a measure for preventing global warming, research is being made for a technology for supplying high voltage direct current power experiencing little power loss in voltage conversion/power transmission and requiring no increase in the thickness of the cable for power supply. Such technology is desired particularly for data apparatuses (e.g., servers) which consume large amounts of power.

The large power supplied to such devices may adversely affect the human body or the performance of electronic devices.

Taking into consideration that maintenance and settings of data apparatuses (e.g., servers) using high voltage are performed by humans, connectors used for such data apparatuses are to have configurations different from those of typical connectors connected to commercial AC power sources.

SUMMARY OF THE INVENTION

The present invention may provide a connector apparatus that substantially eliminate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a connector apparatus and a receiving connector of the connector apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a connector apparatus including a receiving connector connected to a power source and including first and second power jack terminals, a control jack terminal, a control switch including first and second contact points, and an insulative spring positioned below the control switch, and an inserting connector connected to an electronic device and including first and second power plug terminals connected in correspondence with the first and second power jack terminals for receiving power from the power source, and a control plug terminal that extends towards the control switch and applies pressure to the insulative spring for causing the first and second contact points to connect and enabling the power from the power source to be supplied to the electronic device, wherein a part of the insulative spring is configured to melt when an electric arc is generated by disconnecting the connection between the first and second contact points.

Other objects and further features of the present invention will be apparent from the following detailed description when read in conjunction with the accompanying drawings.

Figure 15:
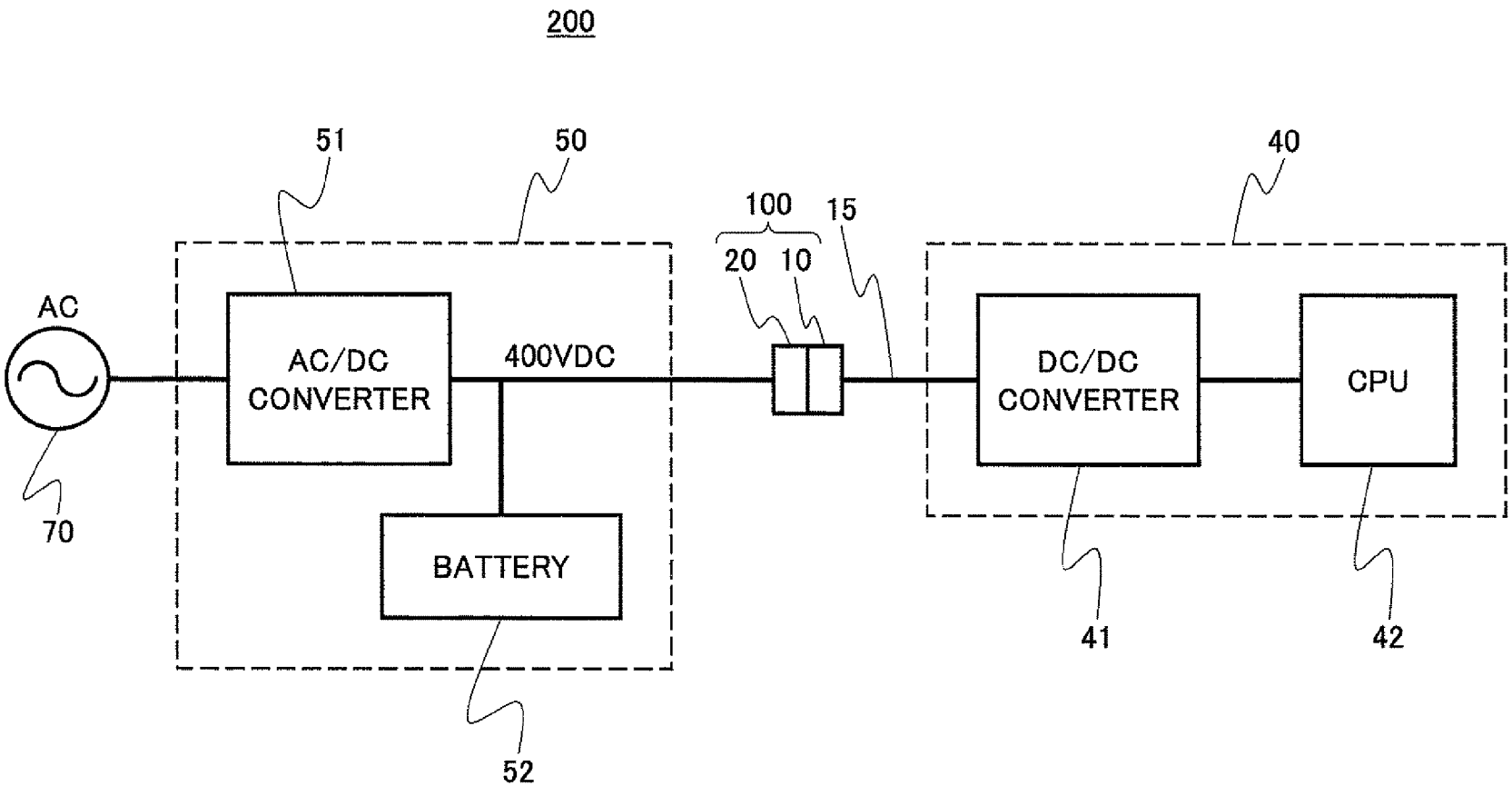
Figure 17A:
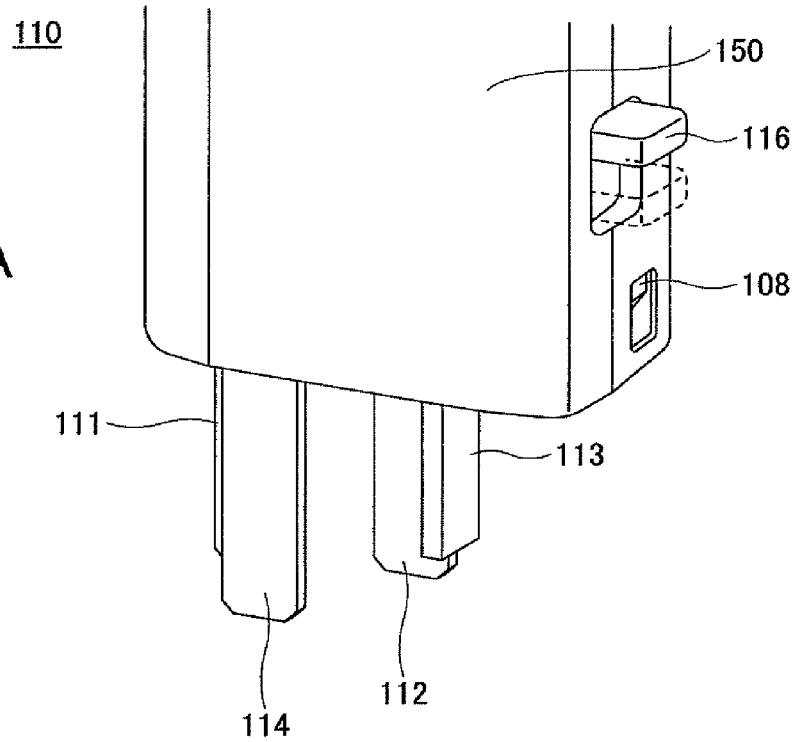
Figure 17B:
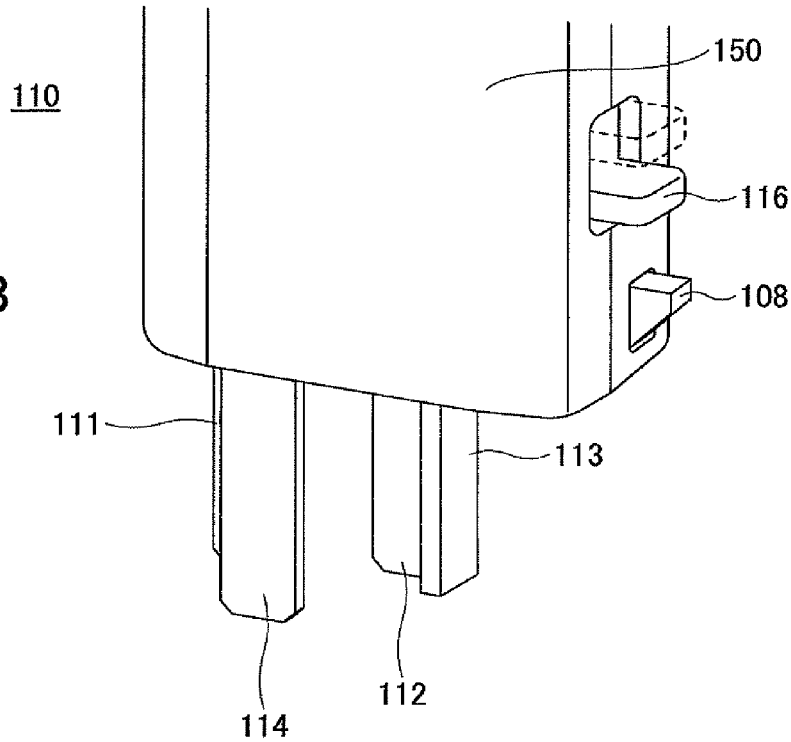
Figure 18A:
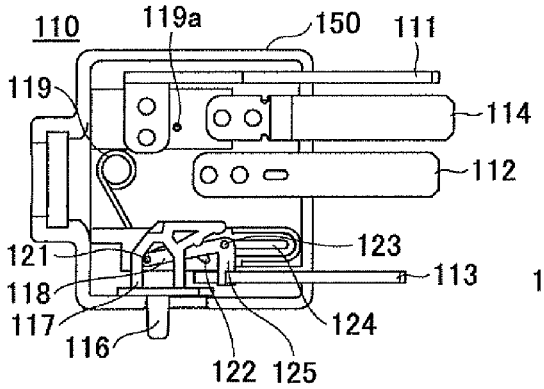
Figure 18B:
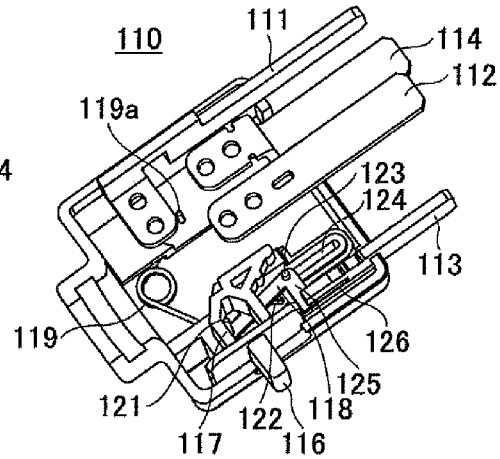
Figure 18C:
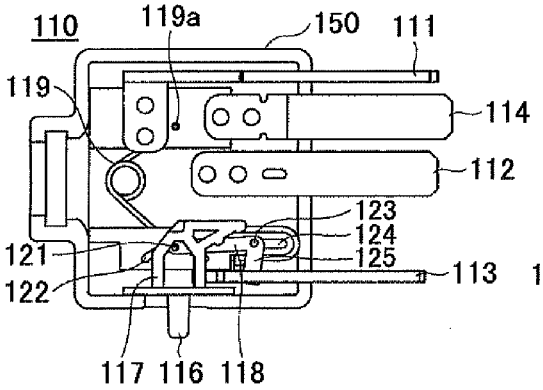
Figure 18D:
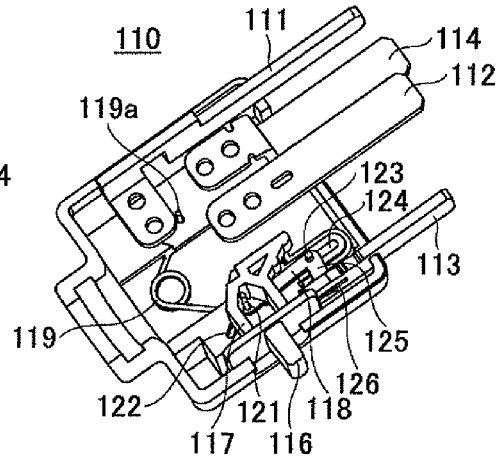
Figure 18E:
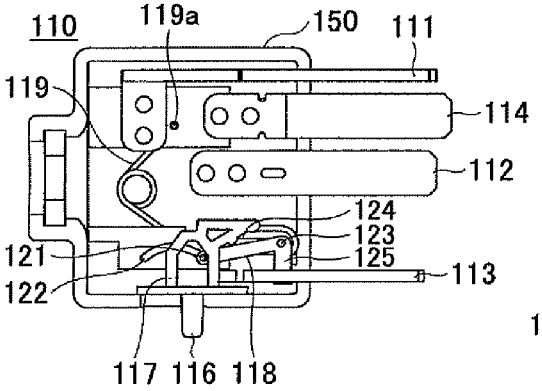
Figure 18F:
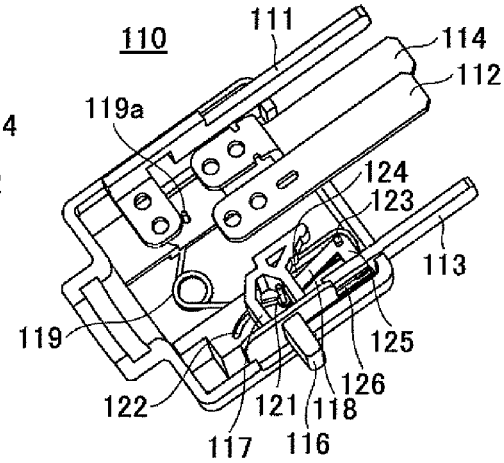
Figure 19:
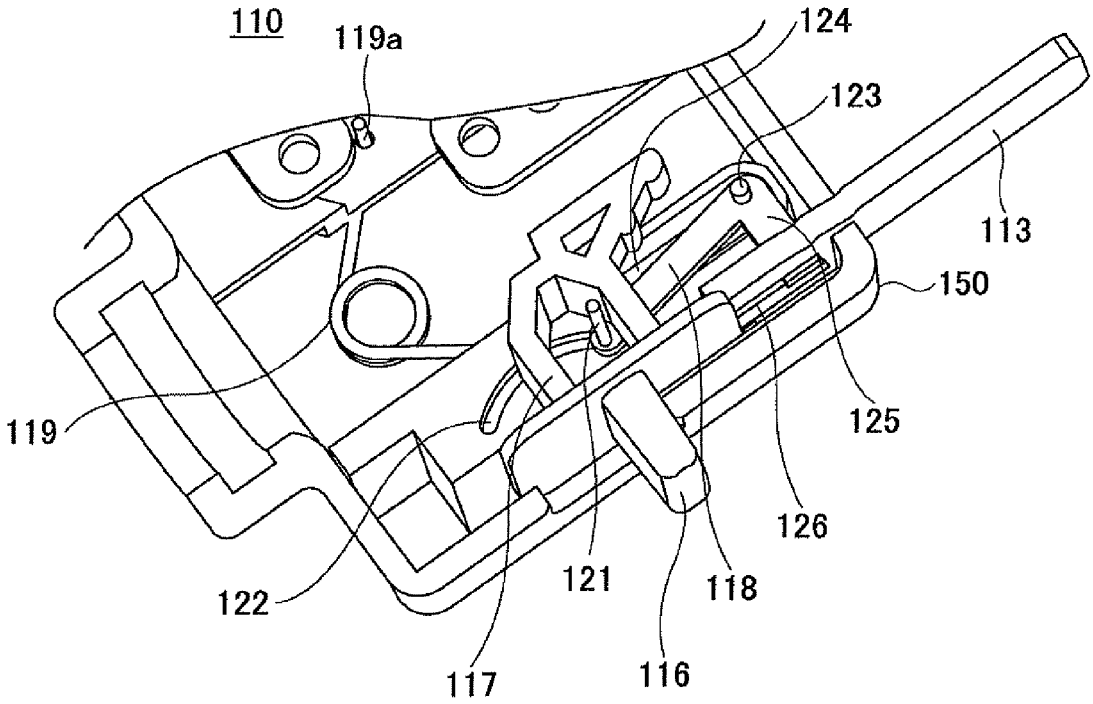
Figure 20:
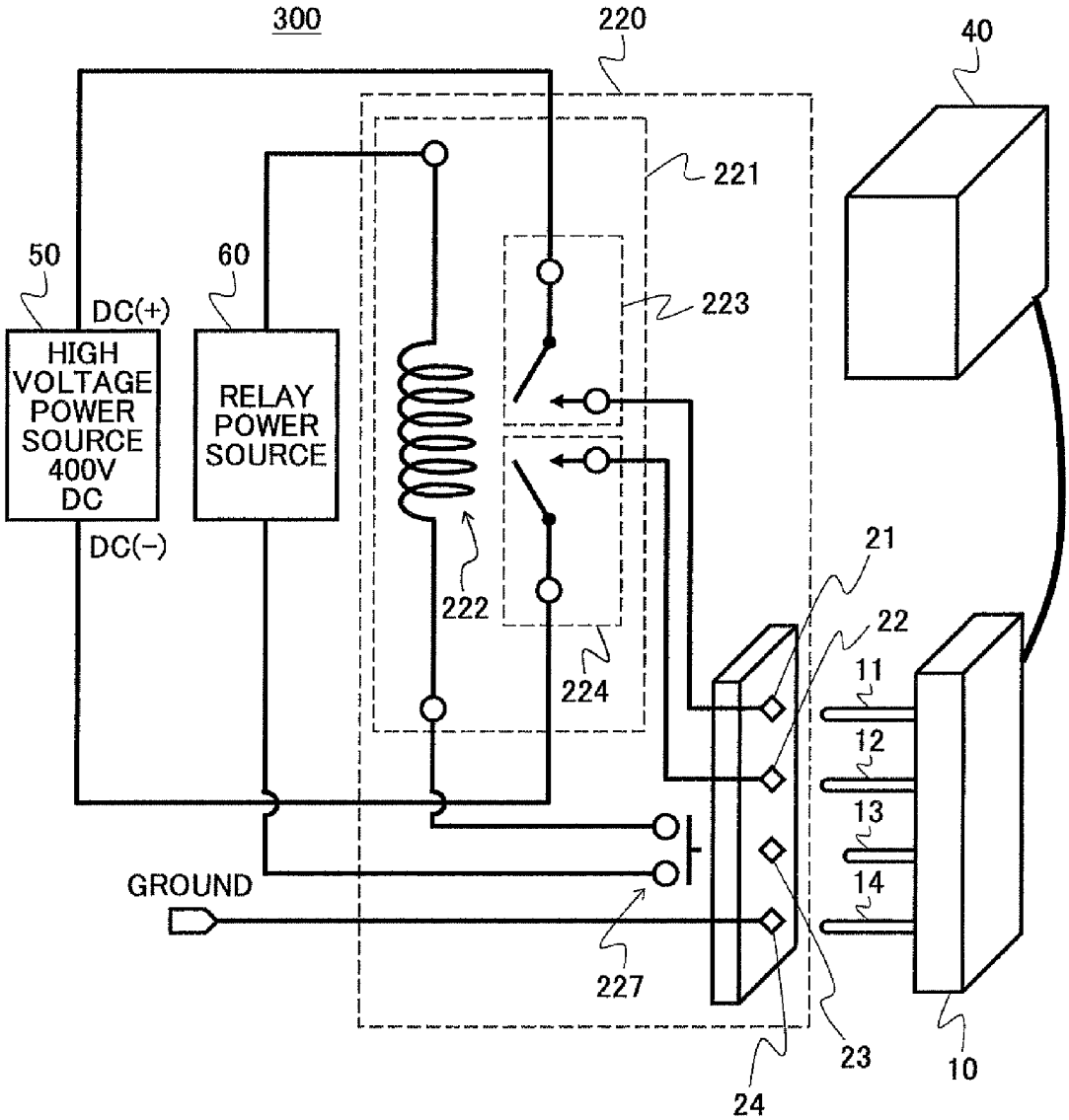
Figure 21A:
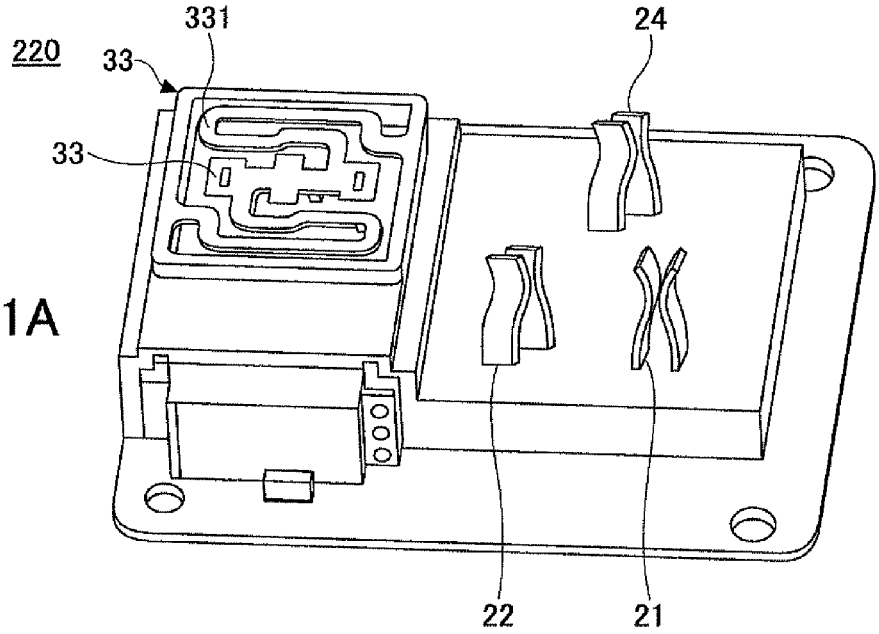
Figure 21B:
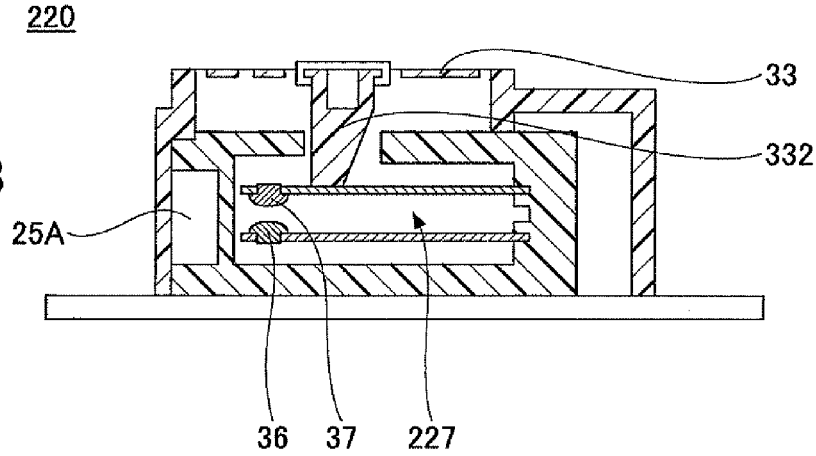
Figure 21C:
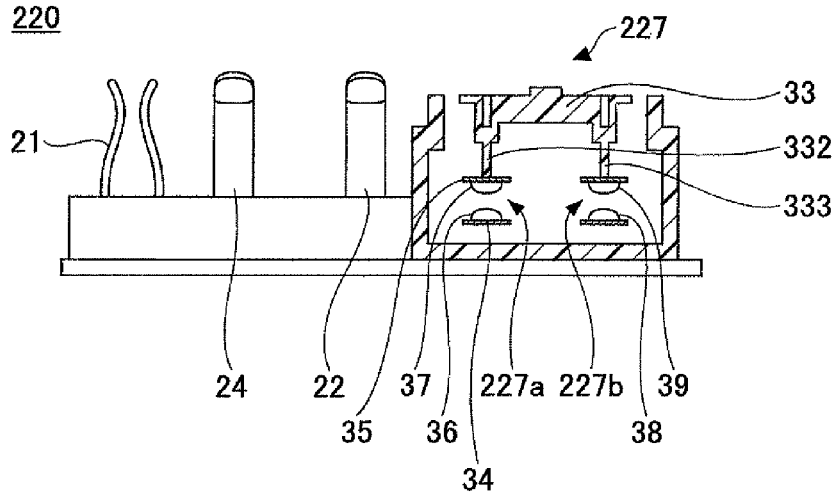
Figure 22:
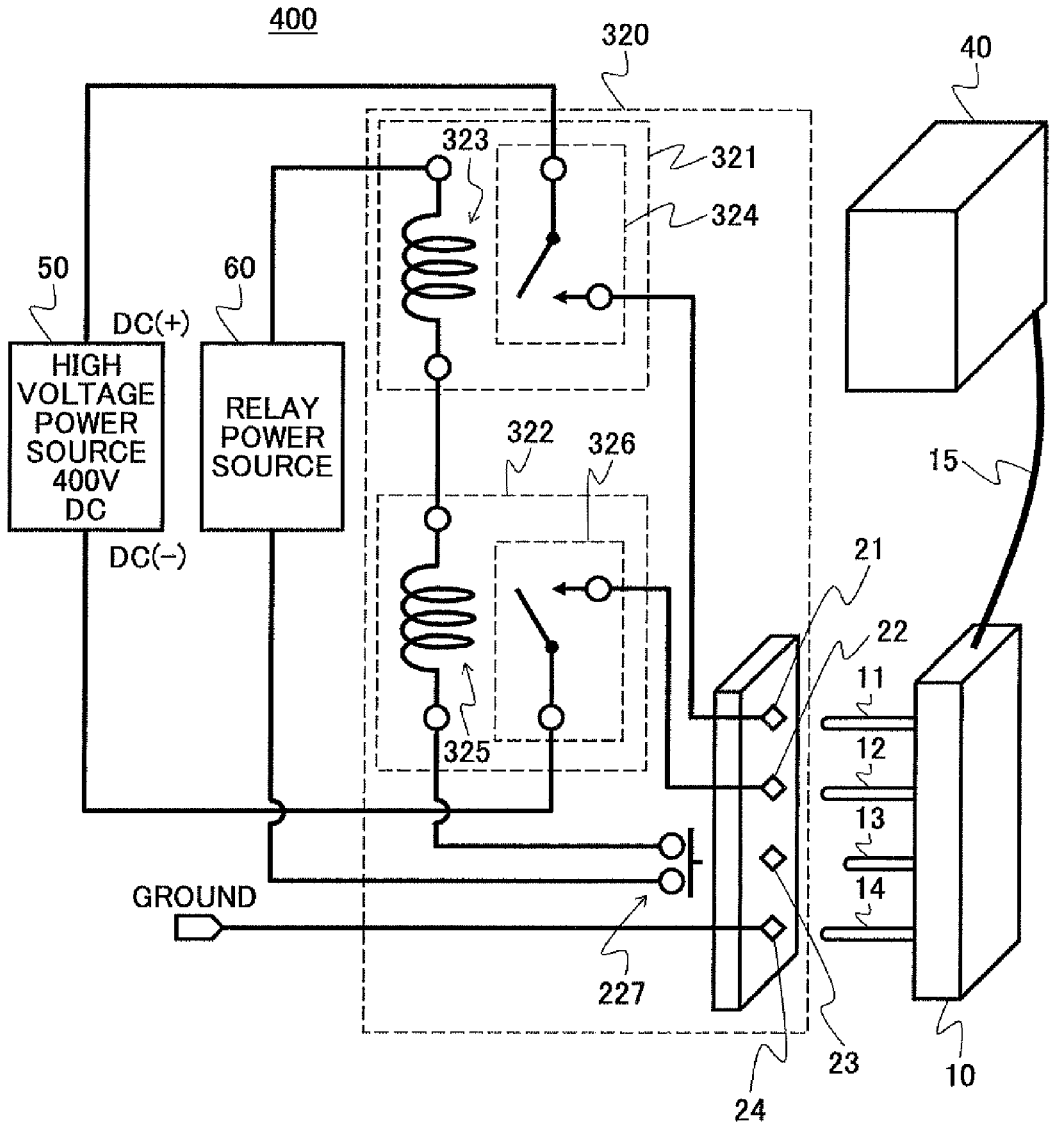

Fig, 14B is a schematic diagram illustrating an inserting connector in a state where the control plug terminal is in an extending state according to the first embodiment of the present invention;

FIG. 15 is a schematic diagram illustrating a configuration of a power supply system using the connector apparatus according to the first embodiment of the present invention;

Fig, 16 is a schematic diagram illustrating a PDU (Power Distribution Unit) using a connector apparatus according to the first embodiment of the present invention;

FIG. 17A is a perspective view illustrating the inserting connector where the control plug terminal is in a contracting state according to the second embodiment of the present invention;

FIG. 17B is a perspective view illustrating an inserting connector where a control plug terminal is in an extending state according to the second embodiment of the present invention;

FIG. 18A is a schematic diagram illustrating the inside of an inserting connector where the control plug terminal is in a contracted state according to the second embodiment of the present invention;

FIG. 18B is a perspective view illustrating the inside of an inserting connector where a control plug terminal is in a contracted state according to the second embodiment of the present invention;

FIG. 18C is a schematic diagram illustrating the inside of an inserting connector where a control plug terminal is in a neutral state according to the second embodiment of the present invention;

FIG. 18D is a perspective view illustrating the inside of an inserting connector where a control plug terminal is in a neutral state according to the second embodiment of the present invention;

FIG. 18E is a schematic diagram illustrating the inside of an inserting connector where a control plug terminal is in an extending state according to the second embodiment of the present invention;

FIG. 18F is a perspective view illustrating the inside of an inserting connector where a control plug terminal is in an extending state according to the second embodiment of the present invention;

FIG. 19 is a partial enlarged view illustrating an inserting connector in the state of FIG. 18F according to the second embodiment of the present invention;

FIG. 20 is a schematic diagram illustrating a connector apparatus, an inserting connector, and a receiving connector according to the third embodiment of the present invention;

FIGS. 21A-21C illustrate the inside of the receiving connector according to the third embodiment of the present invention; and FIG. 22 is a schematic diagram illustrating a connector apparatus, an inserting connector, and a receiving connector according to the fourth embodiment of the present invention.

DESCRIPTION OF THE PREFERRED EMBODIMENTS

In the following, embodiments of the present invention will be described with reference to the accompanying drawings.

[First Embodiment]

A connector apparatus, an inserting apparatus, and a receiving apparatus according to a first embodiment of the present invention are described.

(Configuration of Connector Apparatus, Inserting Apparatus, and Receiving Apparatus)

Figure 1:
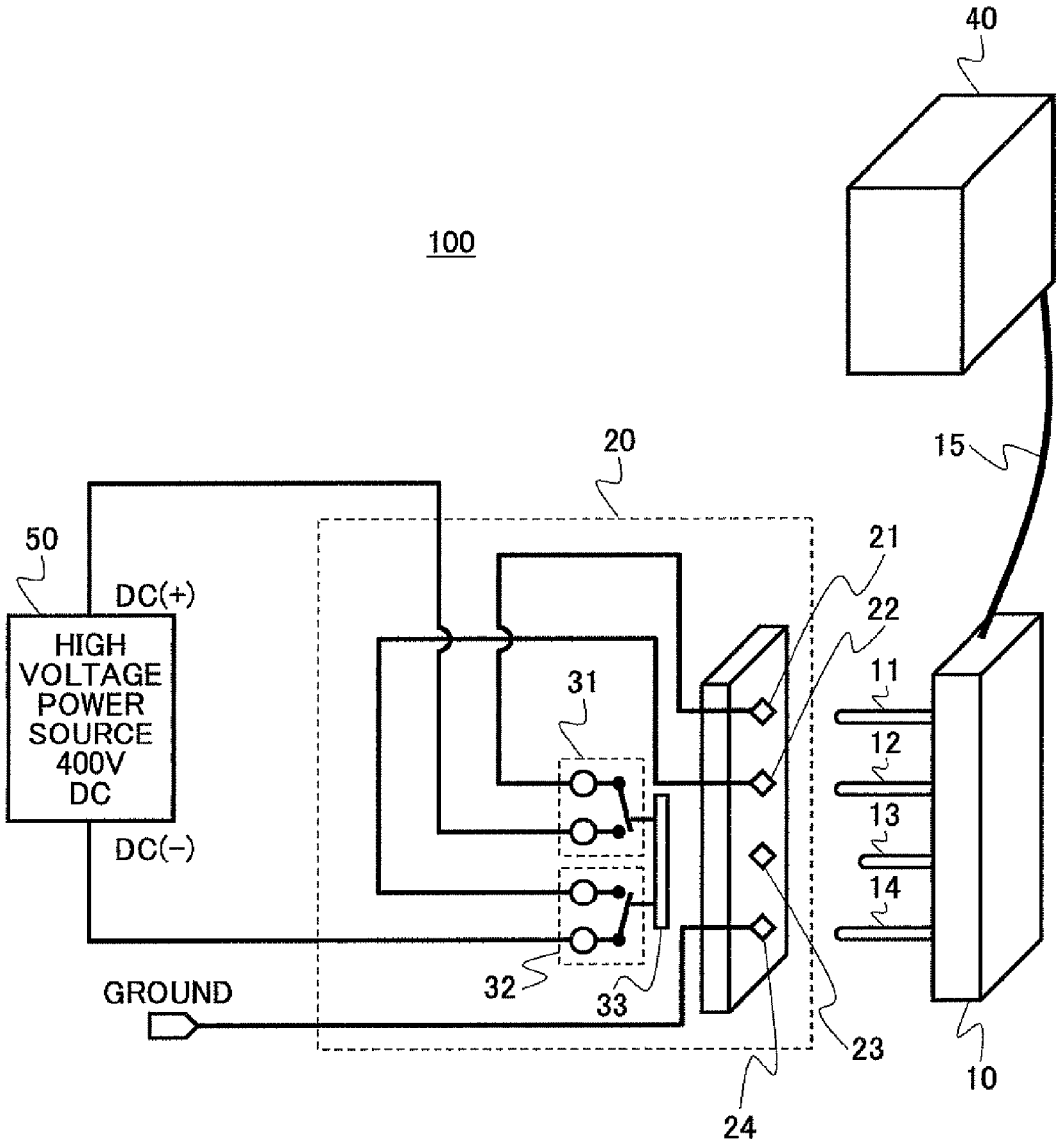
FIG. 1 is a schematic diagram illustrating configurations of a connector apparatus, an inserting apparatus, and a receiving apparatus according to the first embodiment of the present invention.

Configurations of a connector apparatus 100, an inserting apparatus 10, and a receiving apparatus 20 are described with reference to FIG. 1.

The connector apparatus 10 according to an embodiment of the present invention includes the inserting connector 10 and the receiving connector 20. The inserting connector 10 is connected to a data apparatus (e.g., server) 40. The inserting connector 10 includes two power plug terminals 11, 12, a control plug terminal 13, and a ground plug terminal 14. The power plug terminals 11, 12 are for receiving supply of power. The ground plug terminal 14 is for earthing. The control plug terminal 13 is configured to extend and contract in a direction in which the inserting connector 10 is inserted to the receiving connector 20.

The receiving connector 20 is connected to a high voltage power source 50 for supplying power to the inserting connector 10. The receiving connector 20 includes power jack terminals 21, 22 corresponding to the power plug terminals 11, 12, a control jack terminal 23 corresponding to the control plug terminal 13, and a ground jack terminal 24 corresponding to the ground plug terminal 14.

The receiving connector 20 also includes two control switches 31, 32. Each of the control switches 31, 32 may be configured as a leaf spring. By pressing the control switches 31, 32, contact points of the control switches 31, 32 establish contact and allow current to flow therethrough. In this embodiment, an insulative leaf spring 33 is provided immediately above the control switches 31, 32.

The control switch 31 has one terminal connected to a positive output of the high voltage power source 50 and another terminal connected to the power jack terminal 21. The control switch 32 has one terminal connected to a negative output of the high voltage power source 50 and another terminal connected to the power jack terminal 22.

In a state where the inserting connector 10 and the receiving connector 20 are engaged, the contact points of the control switches 31, 32 establish contact by applying a pressing force from the control plug 13 to the control switches 31, 32 via the insulative leaf spring 33.

By connecting the contact points of the control switches 31, 32, power is supplied to the power jack terminal 21, 22 of the receiving connector 20, and power is supplied to the data apparatus 40 via the power plug terminals 11, 12 of the inserting connector 10.

The connector apparatus 100 of the first embodiment has a configuration in which the control switches 31, 32 are connected to corresponding power jack terminals 21, 22. Owing to this configuration, in a case where a high voltage direct current greater than 48 V (moreover, no less than 200 V) is supplied, the supply of power can be controlled by both of the power jack terminals 21, 22. Accordingly, even in a case where high voltage (extremely dangerous if human contact is made) is supplied, greater safety can be attained by controlling the supply of high voltage with both power jack terminals 21, 22.

It is to be noted that the control jack terminal 23 may include a control switch that can be switched on and off in correspondence with the mechanical force applied by the extending/contracting of the control plug terminal 13.

(Structure of Connector Apparatus)

Figure 2A:
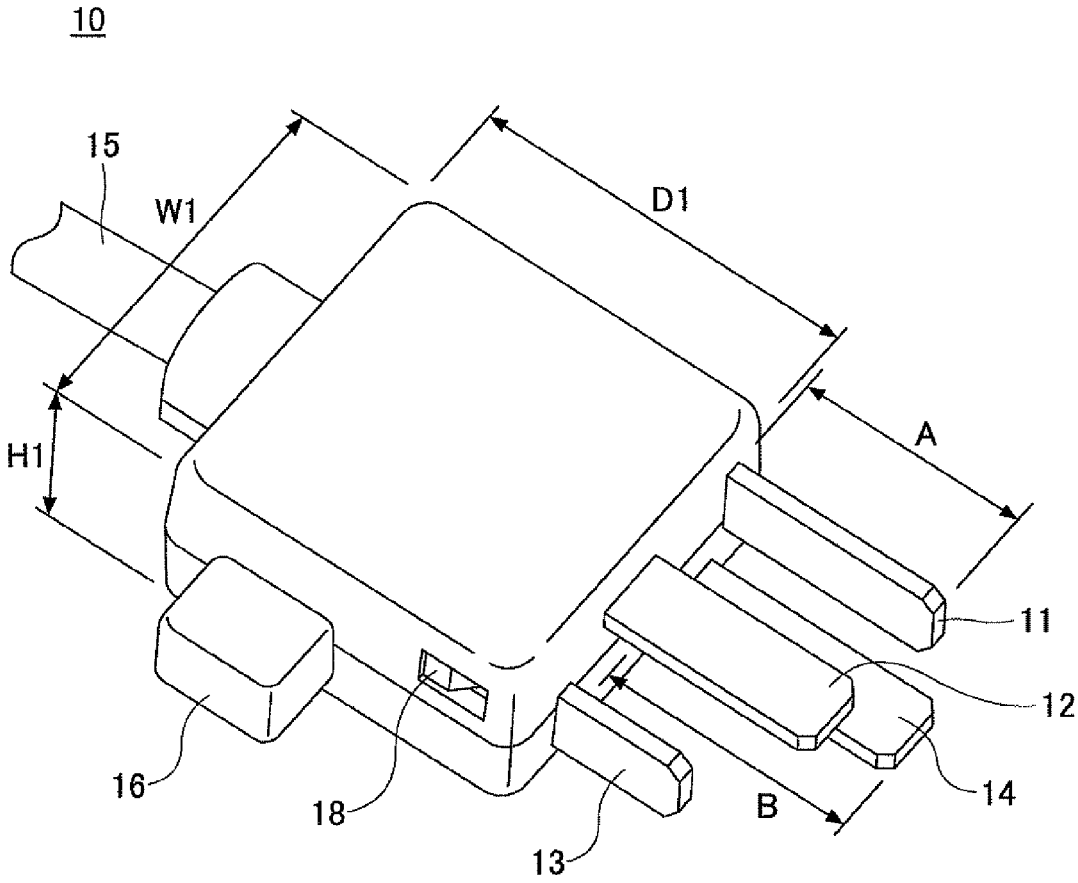
FIG. 2A is a perspective view illustrating the outside of the inserting connector according to the first embodiment of the present invention.
Figure 2B:
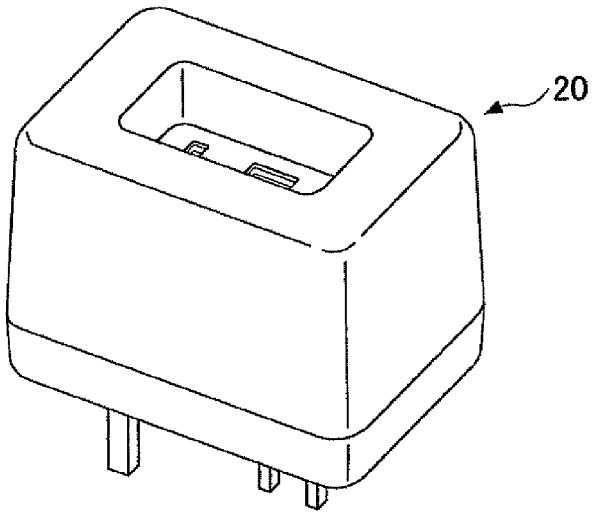
FIG. 2B is a perspective view illustrating the outside of the receiving connector according to the first embodiment of the present invention.
Figure 3A:
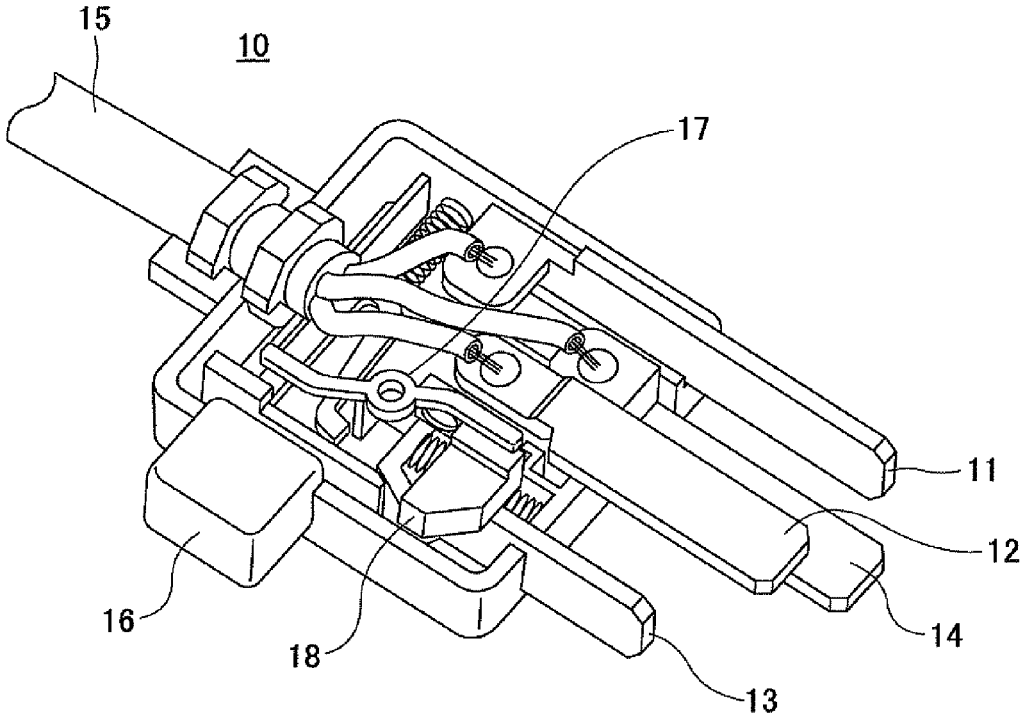
FIG. 3A is a perspective view illustrating the inside of the inserting connector according to the first embodiment of the present invention where the control plug terminal is in a contracting state.
Figure 3B:
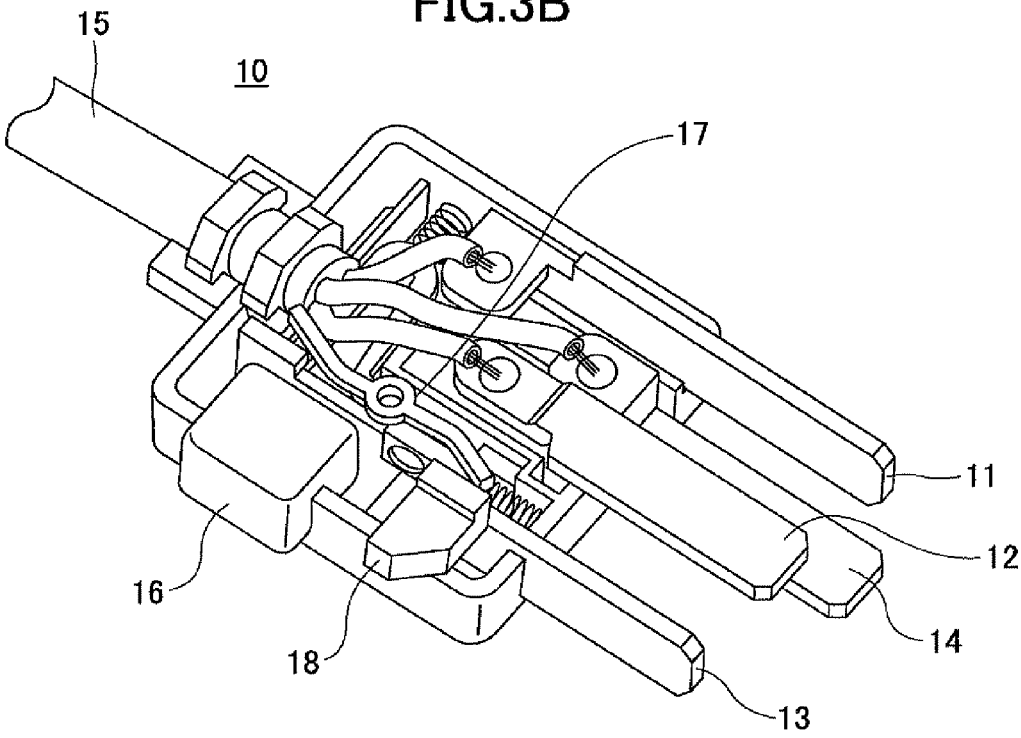
FIG. 3B is a perspective view illustrating the inside of the inserting connector according to the first embodiment of the present invention where the control plug terminal is in an extending state.
Figure 4A:
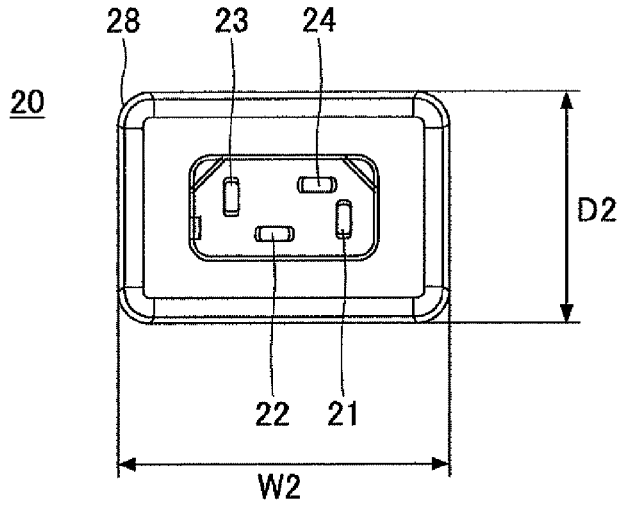
FIG. 4A is a top view illustrating the receiving connector according to the first embodiment of the present invention.
Figure 4B:
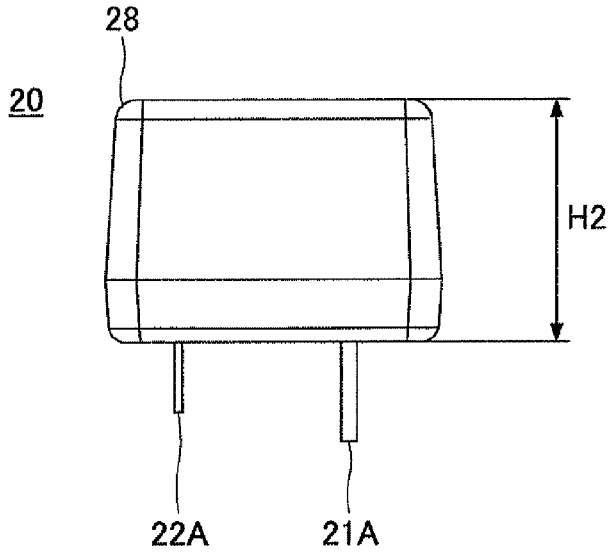
FIG. 4B is a side view illustrating the receiving connector according to the first embodiment of the present invention.
Figure 4C:
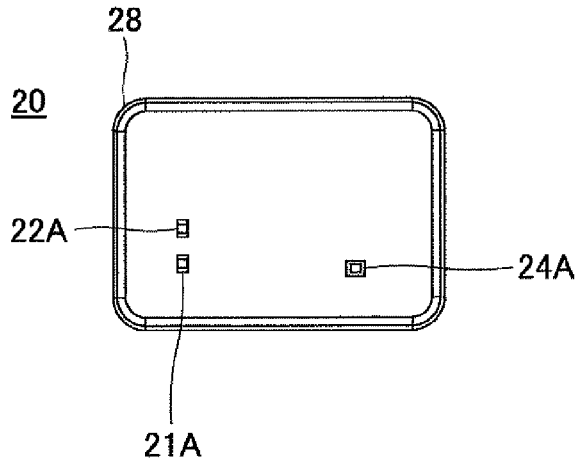
FIG. 4C is a rear view illustrating the receiving connector according to the first embodiment of the present invention.
Figure 5A:
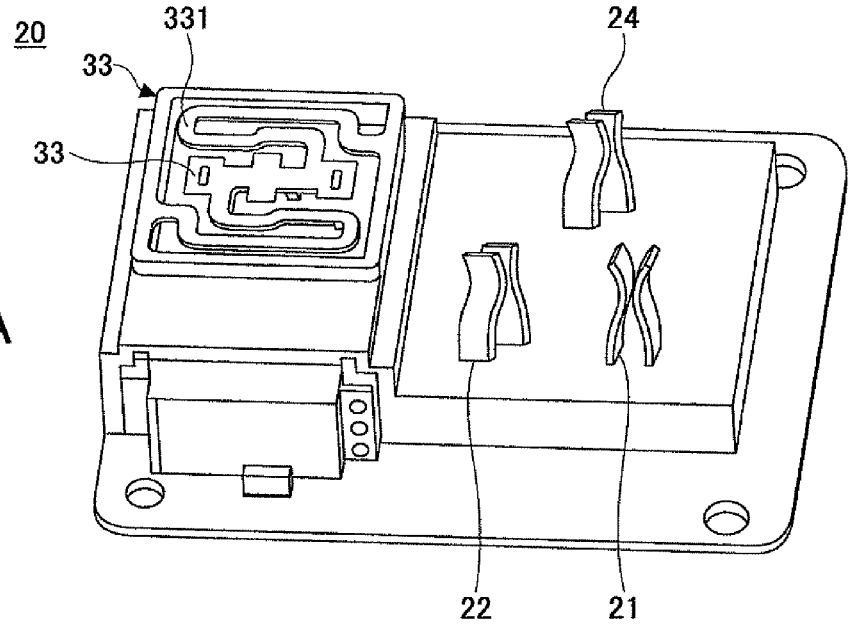
FIG. 5A is a perspective view illustrating the inside of the receiving connector according to the first embodiment of the present invention.
Figure 5B:
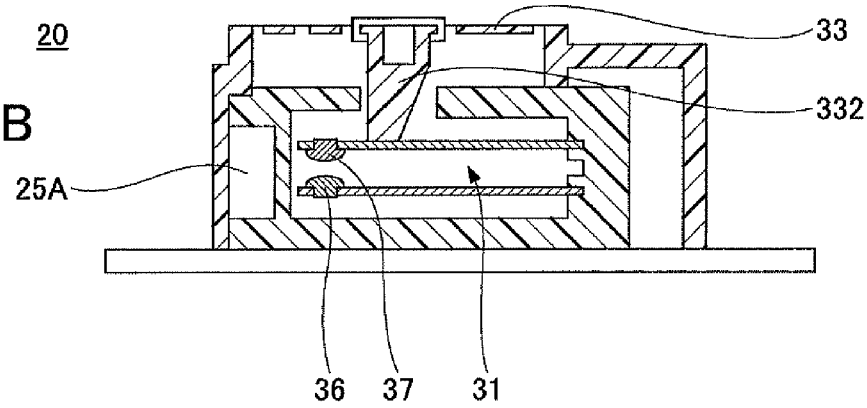
FIG. 5B is a partial cross-sectional side view illustrating the inside of the receiving connector according to the first embodiment of the present invention.
Figure 5C:
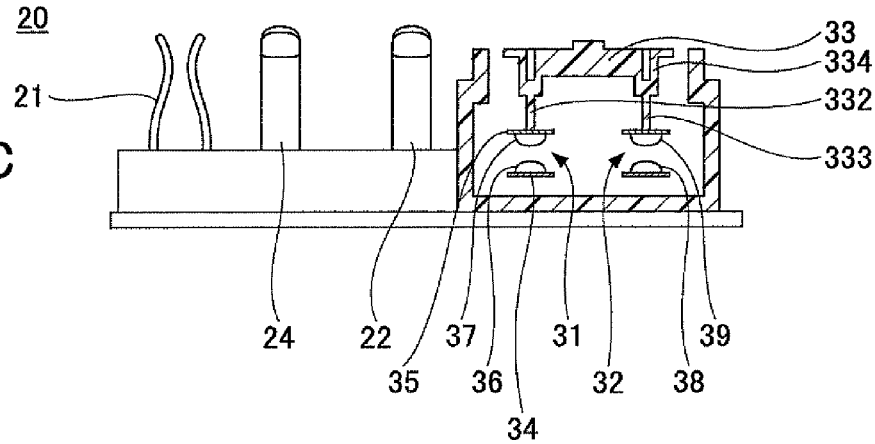
FIG. 5C is a partial cross-sectional front view illustrating the inside of the receiving connector according to the first embodiment of the present invention.

Next, a detailed structure of the connector apparatus 100 according to an embodiment of the present invention is described with reference to FIGS. 2A to 5C. FIG. 2A is a perspective view illustrating the outside of the inserting connector 10 according to an embodiment of the present. invention. FIG. 2B is a perspective view illustrating the outside of the receiving connector 20 according to an embodiment of the present invention. FIG. 3A is a perspective view illustrating the inside of the inserting connector 10 according to an embodiment of the present invention where the control plug terminal 13 is in a contracting state. FIG. 3B is a perspective view illustrating the inside of the inserting connector 10 according to an embodiment of the present invention where the control plug terminal 13 is in an extending state. FIG. 4A is a top view illustrating the receiving connector 20 according to an embodiment of the present invention. FIG. 4B is a side view illustrating the receiving connector 20 according to an embodiment of the present invention. FIG. 4C is a rear view illustrating the receiving connector 20 according to an embodiment of the present invention. FIG. 5A is a perspective view illustrating the inside of the receiving connector 20 according to an embodiment of the present invention. FIG. 5B is a partial cross-sectional side view illustrating the inside of the receiving connector 20 according to an embodiment of the present invention. FIG. 5C is a partial cross-sectional front view illustrating the inside of the receiving connector 20 according to an embodiment of the present invention.

As illustrated in FIG. 2A, the inserting connector 10 according to an embodiment of the present invention includes a main body (casing) 19 having a width W1 of 30 mm, a length D1 of 30 mm, and a height of 16 mm. A power source cable 15 of 400 VDC is connected to one side of the inserting connector 10. The power plug terminals (in this embodiment, metal power plug terminals) 11, 12, the control plug terminal 13, and the ground plug terminal 14 are provided on the other opposite side of the inserting connector 10. In this embodiment, the length A of the power plug terminals 11, 12 is 17 mm, and the length B of the ground plug terminal 14 is 19 mm.

FIG. 3A illustrates the inserting connector 10 in a state immediately after the inserting connector 10 is inserted into the receiving connector 20. Then, in a case where a press-button 16 is pressed, the control plug terminal 13 extends, a hinge 17 rotates, and a lock terminal 18 protrudes from the main body 19 in a direction orthogonal to the inserting direction as illustrated in FIG. 3B.

As illustrated from FIG. 2B to FIG. 4, the receiving connector 20 according to an embodiment of the present invention is configured to allow a part of the inserting connector 10 to be inserted into the receiving connector 20. The receiving connector 20 includes the power jack terminals 21, 22 (to which the power plug terminals 11, 12 are connected), the ground jack 24 (to which the ground plug terminal 14 is connected), and the control jack terminal 23 (to which the control plug terminal 13 in an extending state is connected).

The receiving connector 20 has a rear surface to which the below-described PDU is connected. More specifically, as illustrated in FIG. 4C, a power terminal 21A to be connected to the power jack terminal 21 via the control switch 31, a power terminal 22A to be connected to the power jack terminal via the control switch 32, and a ground terminal 24A to be connected to the ground jack terminal 24 are provided in the rear surface of the receiving connector 20.

The receiving connector 20 according to an embodiment of the present invention includes a main body (casing) 28 having a width W2 of 56 mm, a length D2 of 40 mm, and a height H2 of 40.5 mm.

FIGS. 5A-5C illustrate the inside structure of the receiving connector 20 according to an embodiment of the present invention. Two control switches 31, 32 are provided inside the control jack terminal 23 of the receiving connector 20. The control switch 31 includes two contact points 36, 37, and the control switch 32 includes two contact points 38, 39. The insulative leaf spring 33 is provided above the two control switches 31, 32 and is configured to resiliently deform when pressure is applied from above the leaf spring 33. The resilient deformation of the leaf spring 33 causes the contact point 36 and the contact point 37 of the control switch 31 to contact each other and the contact point 38 and the contact point 39 of the control switch 32 to contact each other, to thereby allow current to flow therethrough. Because high voltage (in this embodiment, 400 VDC) flows in this contacting state, it is dangerous for a tip of the control plug 13 of the inserting connector 10 to directly depress the two control switches 31, 32. Therefore, the contact of the contact points 36-39 of the control switches is caused via the insulative leaf spring 33. In this embodiment, permanent magnets 25A, 25B are provided in the vicinity of the contact points 36-39 of the control switches 31, 32 for preventing generation of electric arc.

(Method of Connecting Connectors of Connector apparatuses)

Figure 6:
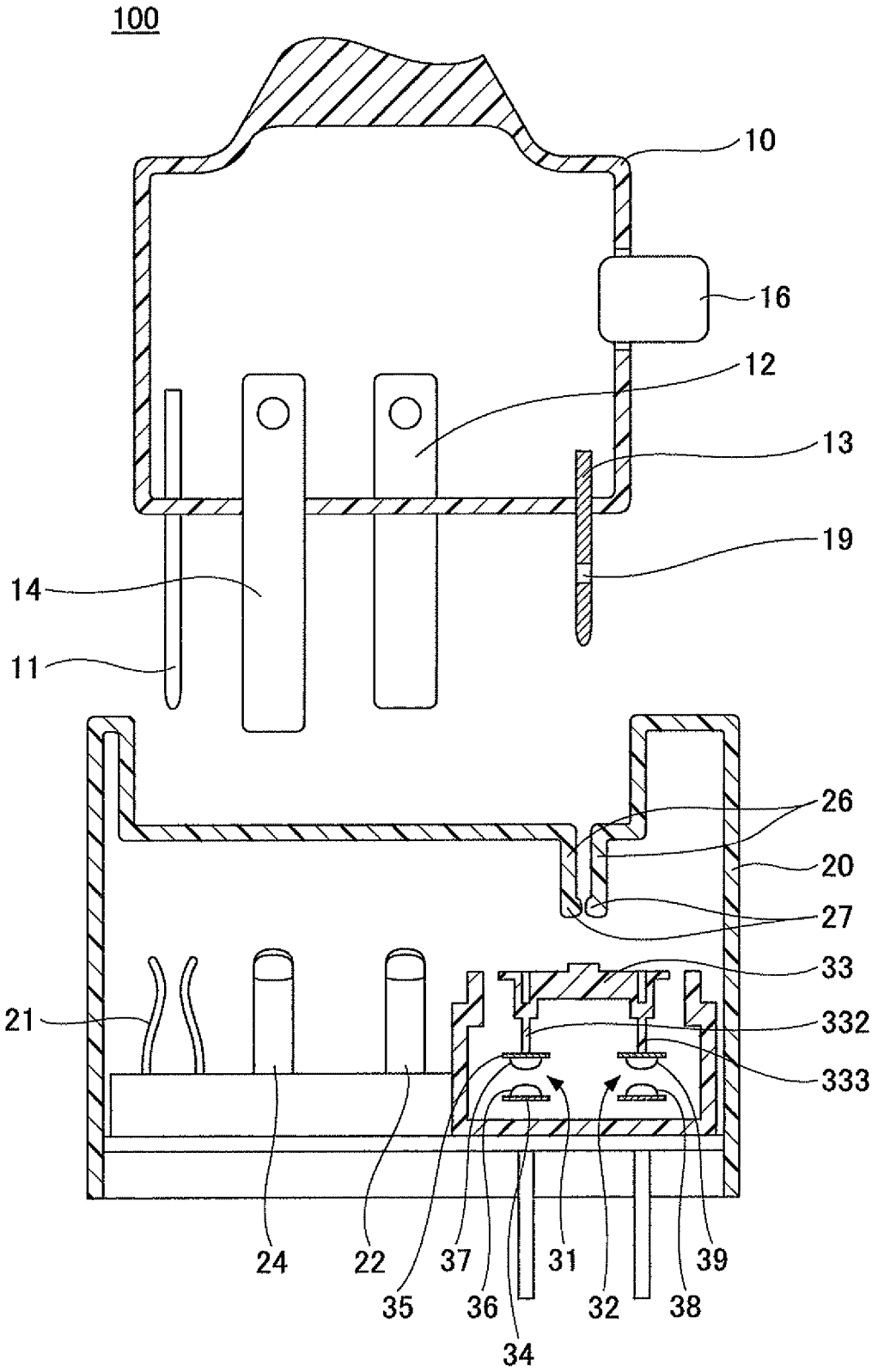
FIGS. 6-8 are for describing a method of connecting an inserting connector and a receiving connector based on a front schematic view of a connector apparatus according to the first embodiment of the present invention.
Figure 7:
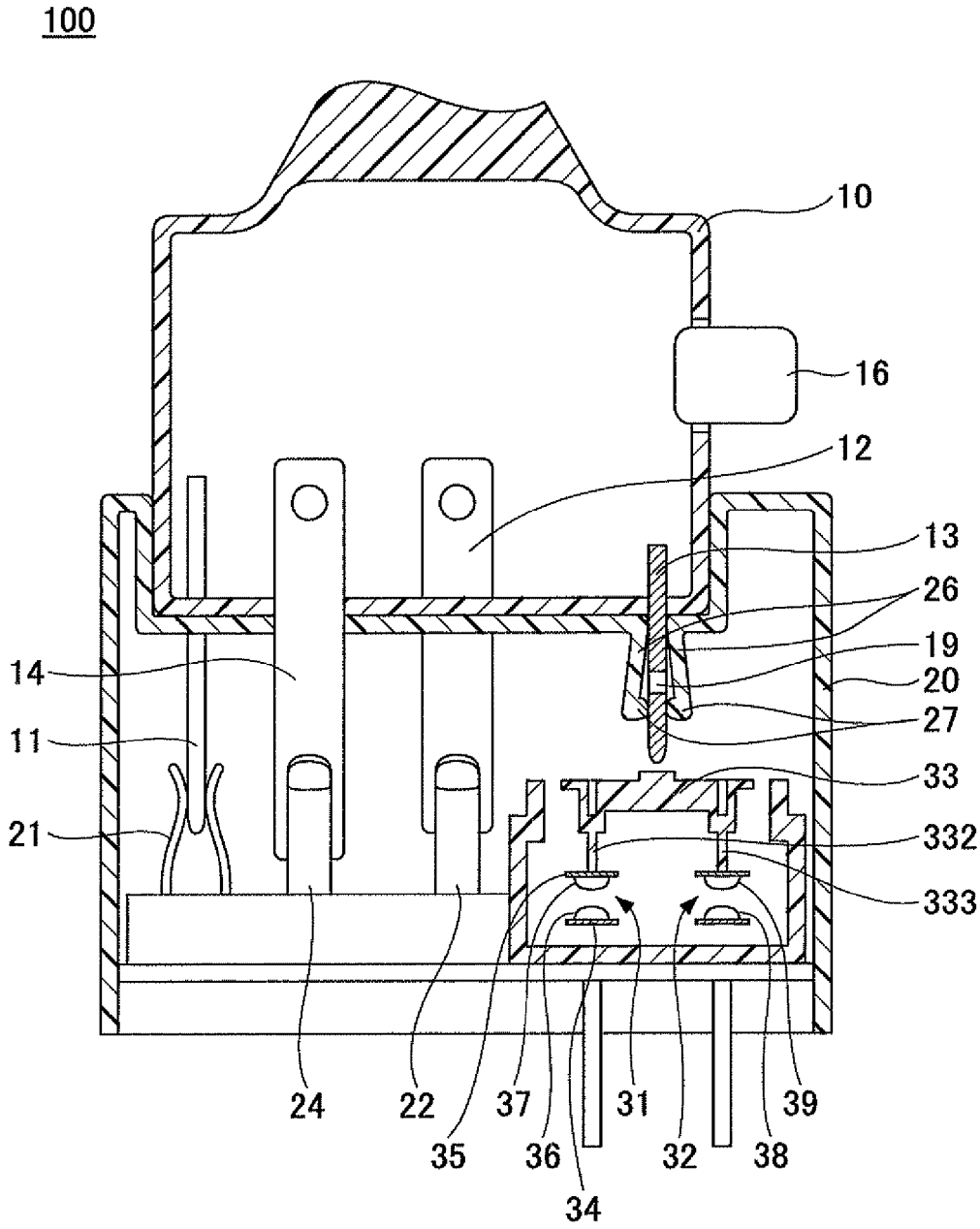
Figure 8:
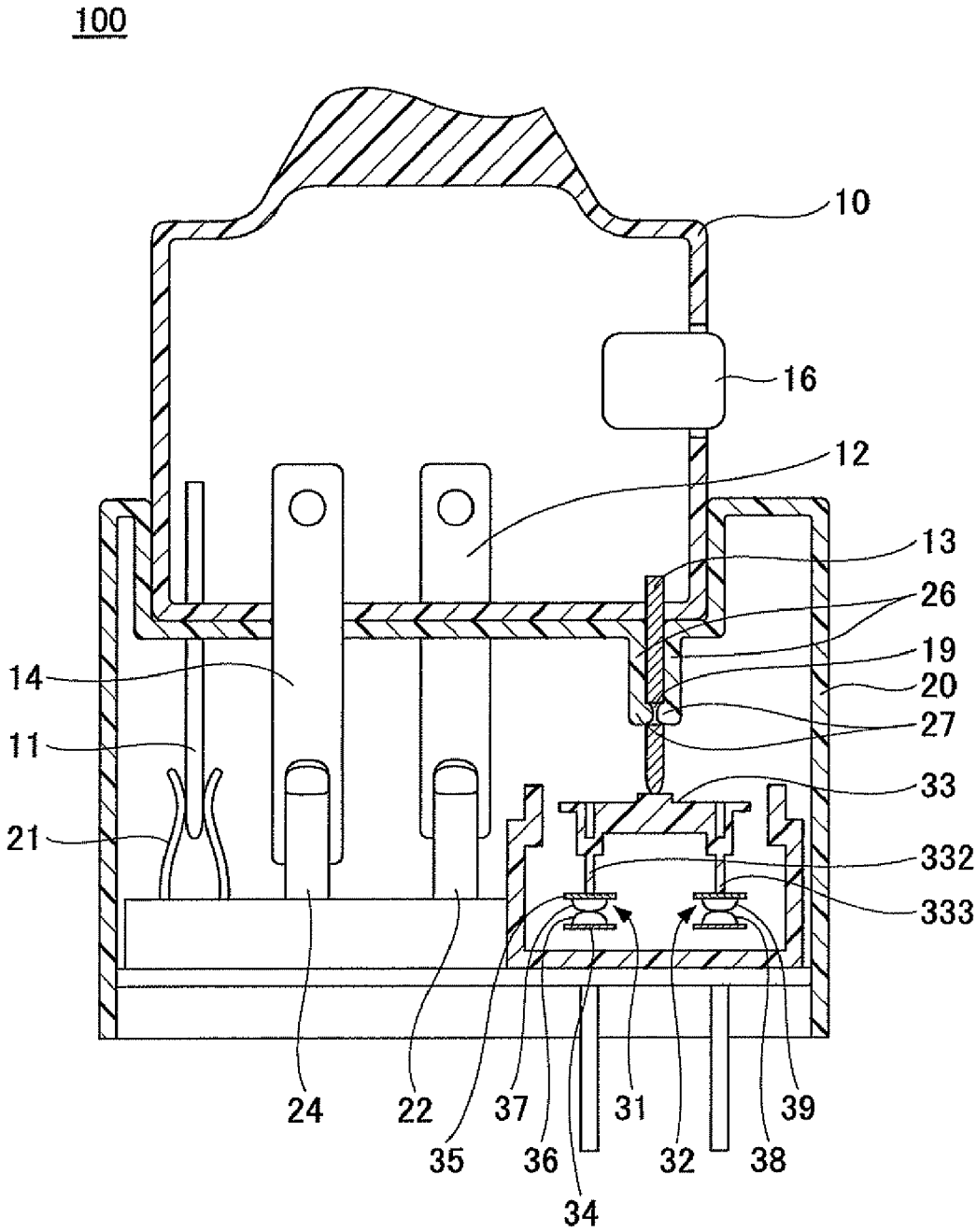
Figure 9:
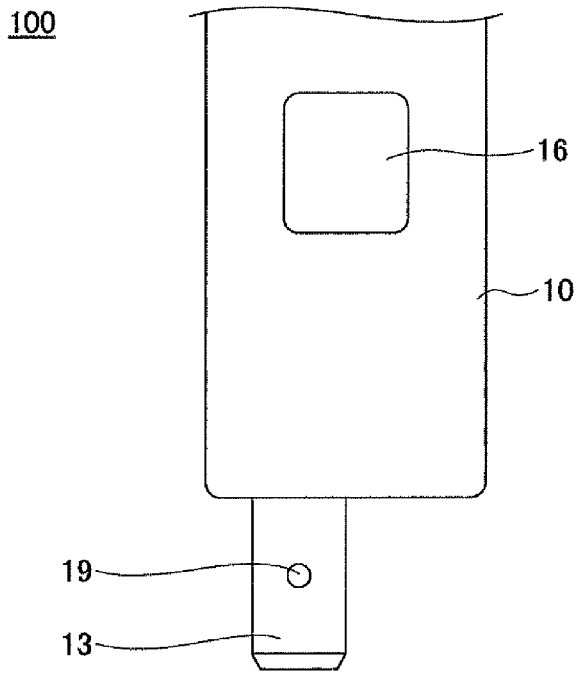
FIGS. 9-11 are for describing a method of connecting an inserting connector and a receiving connector based on a side schematic view of the connector apparatus according to the first embodiment of the present invention.
Figure 9:
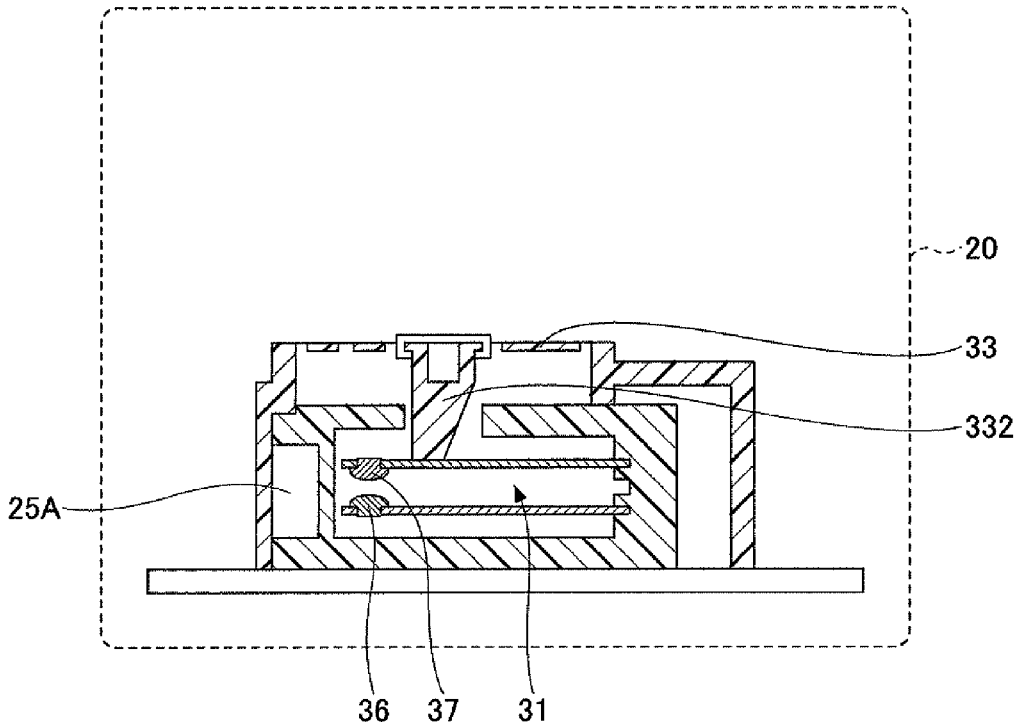
Figure 10:
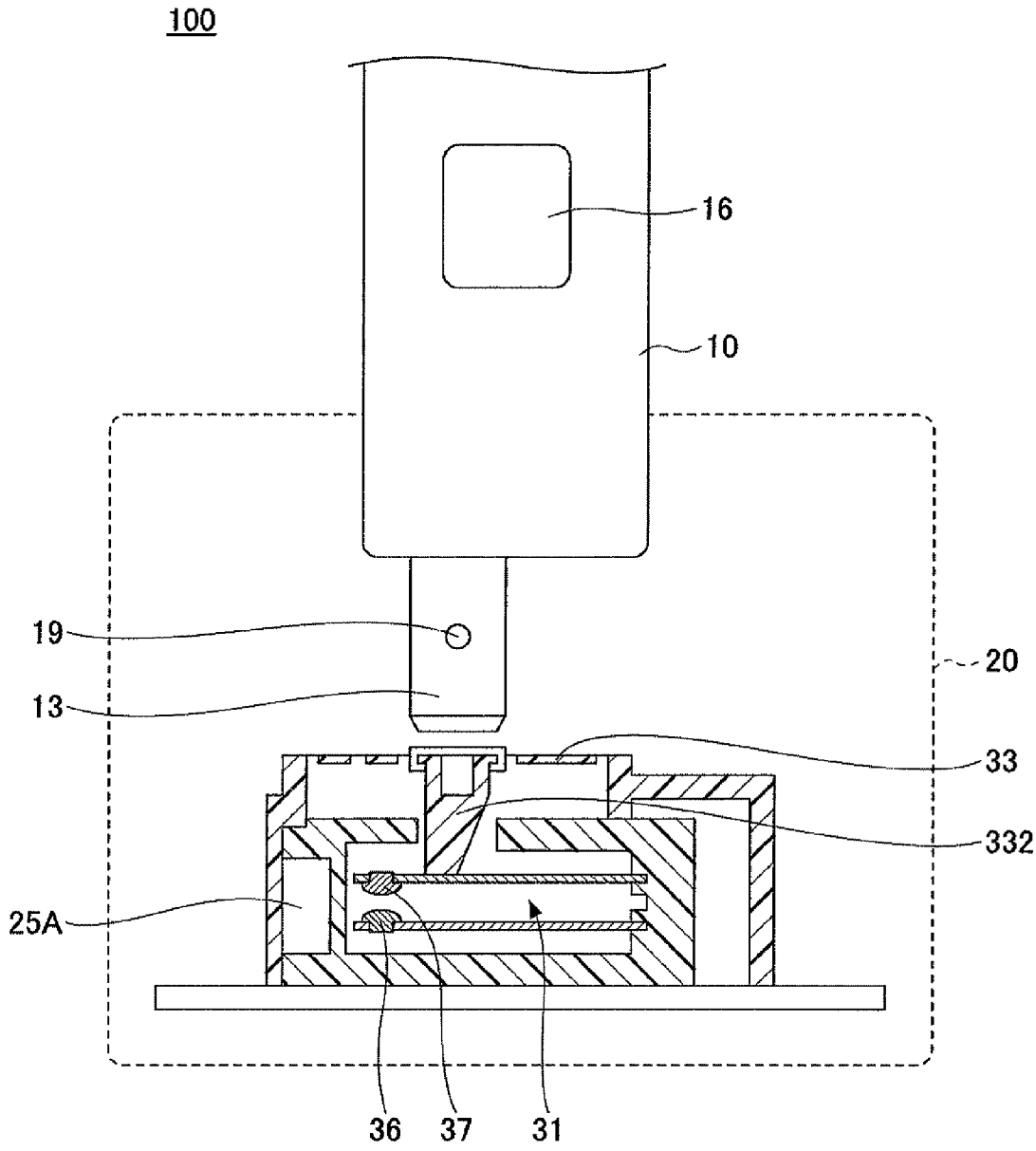
Figure 11:
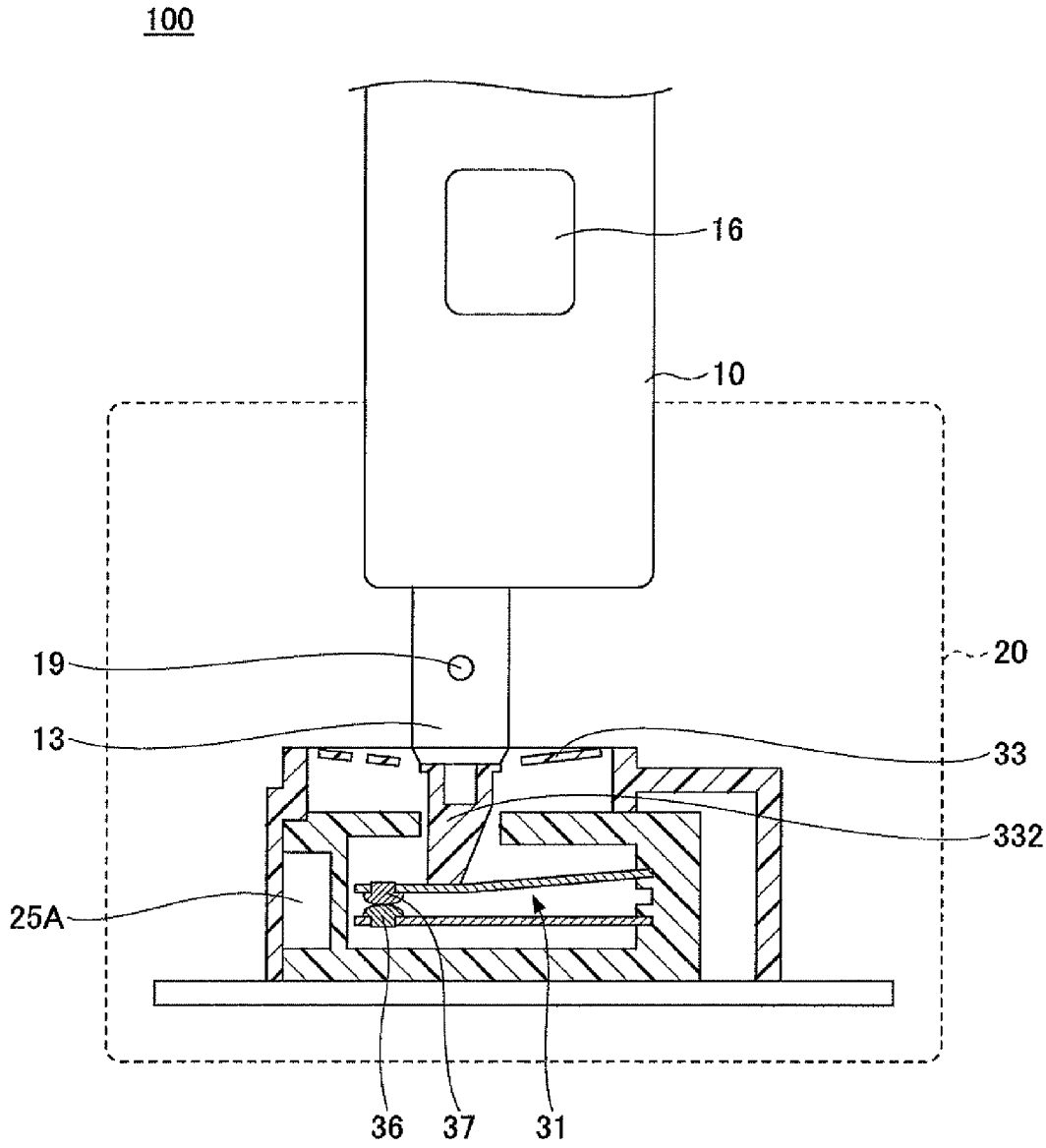

Next, a method of connecting the inserting connector 10 and the receiving connector 20 according to an embodiment of the present invention is described with reference to FIGS. 6-11. FIGS. 6-8 are for describing the method of connecting the inserting connector 10 and the receiving connector 20 based on a front schematic view of the connector apparatus 100. FIGS. 9-11 are for describing the method of connecting the inserting connector 10 and the receiving connector 20 based on a side schematic view of the connector apparatus 100. For making FIGS. 9-11 easier to understand, some components of the connector apparatus 100 (e.g., power plug terminals 11, 12, ground plug terminal 14) are omitted from the drawings.

FIGS. 6 and 9 illustrate a state before the inserting connector 10 and the receiving connector 20 are connected. In the state of FIGS. 6 and 9, the power plug terminal 11 of the inserting connector 10 and the power jack terminal 21 of the receiving connector 20 are not connected. Likewise, in the state of FIGS. 6 and 9, the power plug terminal 12 and the power jack terminal 22 are not connected, and the ground plug terminal 14 and the ground jack terminal 22 are not connected. In the state of FIGS. 6 and 9, the control plug terminal 13 is in a contracting state, and the press-button 16 is in a projecting state (state before being pressed for extending the control plug terminal 13).

In the state of FIGS. 6 and 9, the receiving connector 20 has the control switch 31 and the power jack terminal 21 in a connected state. More specifically, the control switch 31 is formed of a leaf spring part 35 and the contact points 36, 37. The contact point 36 is connected to the power jack terminal 21. In this embodiment, the leaf spring part 35 is formed of a metal material having the shape of a leaf spring. The contact point 37 is connected to the power source 50 via the leaf spring part 35. Likewise, the control switch 32 is connected to the power jack terminal 22 and also connected to the power source 50. As described above, when a pressing force is applied from above the insulative leaf spring 33, the insulative leaf spring 33 positioned above the control switches 31, 32 resiliently deforms and transmits the pressing force to the control switches 31, 32.

As illustrated in FIG. 5A, the leaf spring 33 includes plural U-shaped curved parts 331. Because the length of the leaf spring 33 is greater compared to that of a straight leaf spring, the leaf spring 33 can have a large amount of displacement. Therefore, even in a case where only a small amount of space can be provided for the leaf spring 33, a large amount of displacement can be attained for the leaf spring 33.

The receiving connector 20 includes a pair of arms 26 that flex in a direction orthogonal to the inserting direction of the control plug terminal 13. The pair of arms flex in correspondence with the extending/contracting of the control plug terminal 13.

Next, FIGS. 7 and 10 illustrate a state where the inserting connector 10 and the receiving connector 20 are connected. In the state of FIGS. 7 and 10, the power plug terminal 11 and the power jack terminal 21 are engaged, the power plug terminal 12 and the power jack terminal 22 are engaged, and the ground plug terminal and the ground jack terminal 24 are engaged.

In the state of FIGS. 7 and 10, the control plug terminal 13 remains in a contracting state. Further, in the state of FIGS. 7 and 10, the press-button 16 remains in a projecting state (state before being pressed for extending the control plug terminal 13). Accordingly, the contact points 36, 37 of the control switch 31 are not in contact. Likewise, the contact points 38, 39 of the control switch 32 are not in contact. The control plug terminal 13 is thrusted into the space between the pair of arms 26 to cause the arms to flex and spread apart from each other.

Next, FIGS. 8 and 11 illustrate a state where the inserting connector 10 being inserted into the receiving connector 20 and having the control plug terminal 13 in an extending state.

More specifically, by pressing the press-button 16, the control plug terminal 13 extends, so that a tip of the control plug terminal 13 applies a pressing force to the insulative leaf spring 33 and causes the insulative leaf spring 33 to resiliently deform. The resilient deformation of the insulative leaf spring 33 causes the leaf spring part 35 of the control switch 31 to bend and causes the contact point 36 and the contact point 37 to make contact.

By the contact (connection) between the contact point 36 and the contact point 37, the power from the power source 50 (see FIG. 1) is supplied to the power jack terminal 21. Likewise, the power from the power source 50 is supplied to the power jack terminal 22. Accordingly, the data apparatus 40, which is connected to the inserting connector 10, can be supplied with power from the power source 50 via the power plug terminals 11, 12 connected to the power jack terminals 21, 22.

When the control plug terminal 13 is extended, the arms 26 resiliently return to their initial position. In this state, a protruding part 27 provided to each of the arms 26 engages a corresponding engagement hole 19 of the control plug terminal 13. Accordingly, the control plug 13 is prevented from being unexpectedly pulled out and is maintained in the extending position.

Accordingly, the control plug terminal 13 can be prevented from being unexpectedly pulled-out when power is being supplied from the power source 50. Thereby, safety during the supplying of power can be increased.

In disengaging the inserting connector 10 from the receiving connector 20, first, the press-button 16 is moved to a pull-out direction (to the rightward direction in FIG. 8). By moving the press-button 16 to the pull-out direction, the control plug terminal 13 contracts. The contracting of the control plug terminal 13 causes the arms 26 to spread apart from each other and detach the protruding part 27 from the engagement hole 19. Further, the leaf spring 33 resiliently returns to its initial state when the control plug terminal 13 contracts. Accordingly, the leaf spring part 35 resiliently returns to its initial state, and the contact between the contact point 36 and the contact point 37 is released. Likewise, the contact between the contact point 38 and the contact point 39 is released.

In this process of disengaging the inserting connector 10 from the receiving connector 20, an electric arc (arc current) may be generated between the contact point 36 and the contact point 37 and between the contact point 38 and the contact point 39. In a case where the electric arc is generated, an excessive load may be applied to the data apparatus 40 connected to the receiving connector 10. It is dangerous to re-supply power to the data apparatus 40 after the data apparatus 10 experiences such excessive load. It is particularly dangerous in a case where a high voltage direct current power greater than 48 V (moreover, no less than 200 V) is supplied from the power source 50.

However, the leaf spring 33 according to an embodiment of the present invention includes contact parts 332, 333 that contact the control switches 31, 32, respectively. The contact parts 332, 333 are configured to melt from the heat of the generated electric arc. More specifically, the leaf spring 33 is formed from a thermoplastic resin such as PBT (poly(butylene terephthalate)) or PC (poly carbonate). The contact parts 332, 333 of the leaf spring 33 are formed in a manner protruding from a main body part 334 of the leaf spring 33 (see, for example, FIG. 5C), so that the contact part 332, 333 can melt more easily.

By melting the contact parts 332, 333, the contact point 36 and the contact point 37 become disconnected, and the contact point 38 and the contact point 39 become disconnected. Accordingly, re-supplying of power after electric arc has been generated can be prevented.

From the standpoint of easily melting the contact parts 332, 333, the melting point of the leaf spring 33 is preferably equal to or less than 250° C., and more preferably equal to or less than 180° C. From the standpoint of endurance and reliability of the leaf spring 33, the melting point of the leaf spring 33 is preferably equal to or greater than 150° C.

Figure 12A:
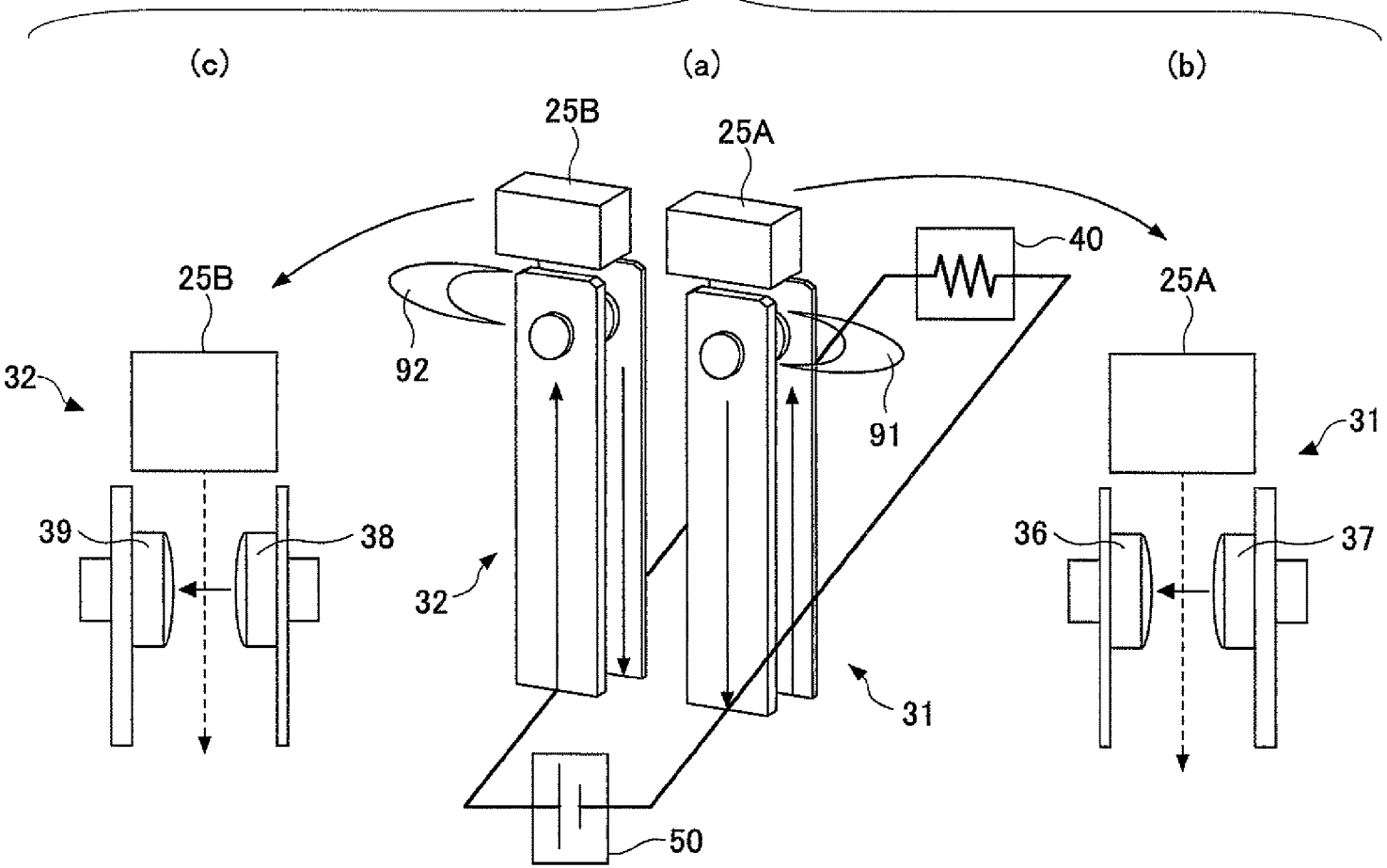
FIGS. 12A and 12B are schematic diagrams for describing contact points of control switches according to the first embodiment of the present invention.
Figure 12B:
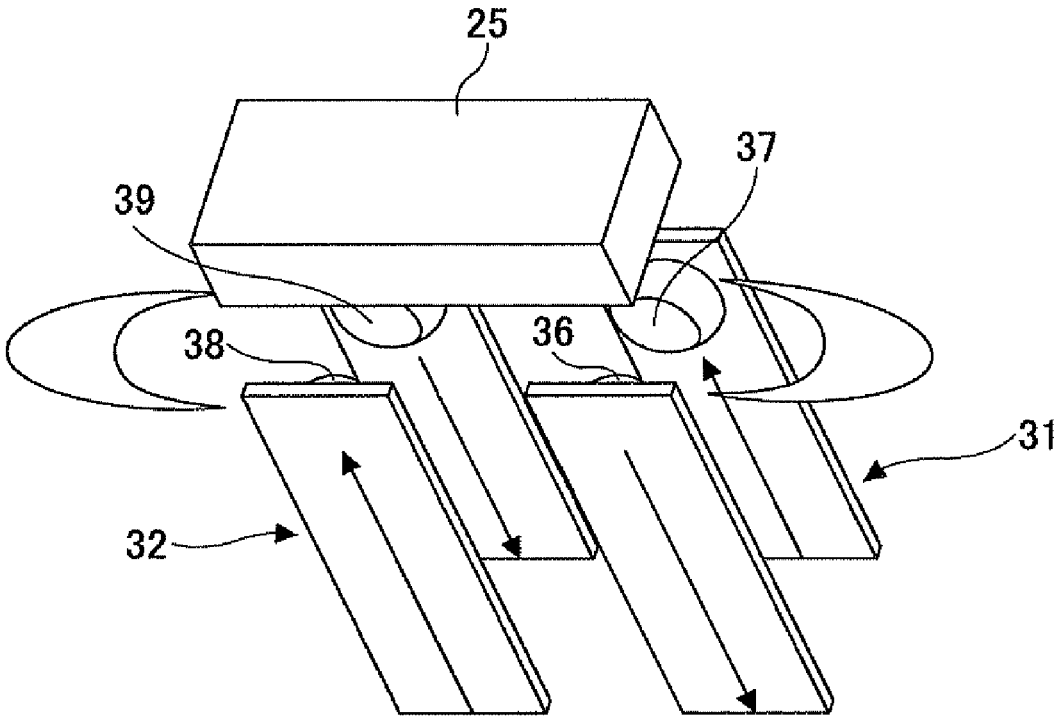

Next, the contact points 36, 37 of the control switch 31 and the contact points 38, 39 of the control switch 32 are described with reference to FIGS. 12A and 12B. As illustrated in FIGS. 5B and 12A, the permanent magnet 25A is provided in the vicinity of the contact points 36, 37 of the control switch 31. Likewise, the permanent magnet 25B is provided in the vicinity of the contact points 38, 39 of the control switch 31.

As illustrated in (a) of FIG. 12A, the straight arrows illustrated on the control switch 31 indicate the direction of the flow of electric current when the contact point 36 and the contact point 37 are connected. Likewise, the straight arrows illustrated on the control switch 32 indicate the direction of the flow of electric current when the contact point 36 and the contact point 37 are connected. In this state where both pairs of contact points 36, 37, 38, 39 are connected, the current from the power source 50 flows through the control switches 31, 32 and to the data apparatus 40. By contracting the control plug terminal 13 in this state, the contact point 36 and the contact point 37 of the control switch 31 and the contact point 38 and the contact point 39 of the control switch 32 separate from each other. At the moment this separation occurs, an electric arc (arc current) is generated between the contact point 36 and the contact point 37 and between the contact point 38 and the contact point 39.

However, by providing the permanent magnet 25A in the vicinity of the contact point 36 and the contact point 37, the permanent magnet 25A generates a magnetic flux indicated with a dotted arrow of (b) of FIG. 12A. As illustrated in (a) of FIG. 12A, the arc current is deflected and eliminated in a manner illustrated with reference numeral 91 owing to the Lorentz's force based on Fleming's left hand rule. Likewise, by providing the permanent magnet 25B in the vicinity of the contact point 38 and the contact point 39, the permanent magnet 25B generates a magnetic flux indicated with a dotted arrow of (c) of FIG. 12A. As illustrated in (a) of FIG. 12A, the arc current is deflected and eliminated in a manner illustrated with reference numeral 92 owing to the Lorentz's force based on Fleming's left hand rule. Accordingly, the supply of power can be promptly cut off. Thus, power supply can be performed with greater safety. Although the embodiment of FIG. 12A uses two permanent magnets 25A, 25B, a single permanent magnet 25 may be alternatively used as illustrated in the embodiment illustrated in FIG. 12B.

Figure 13A:
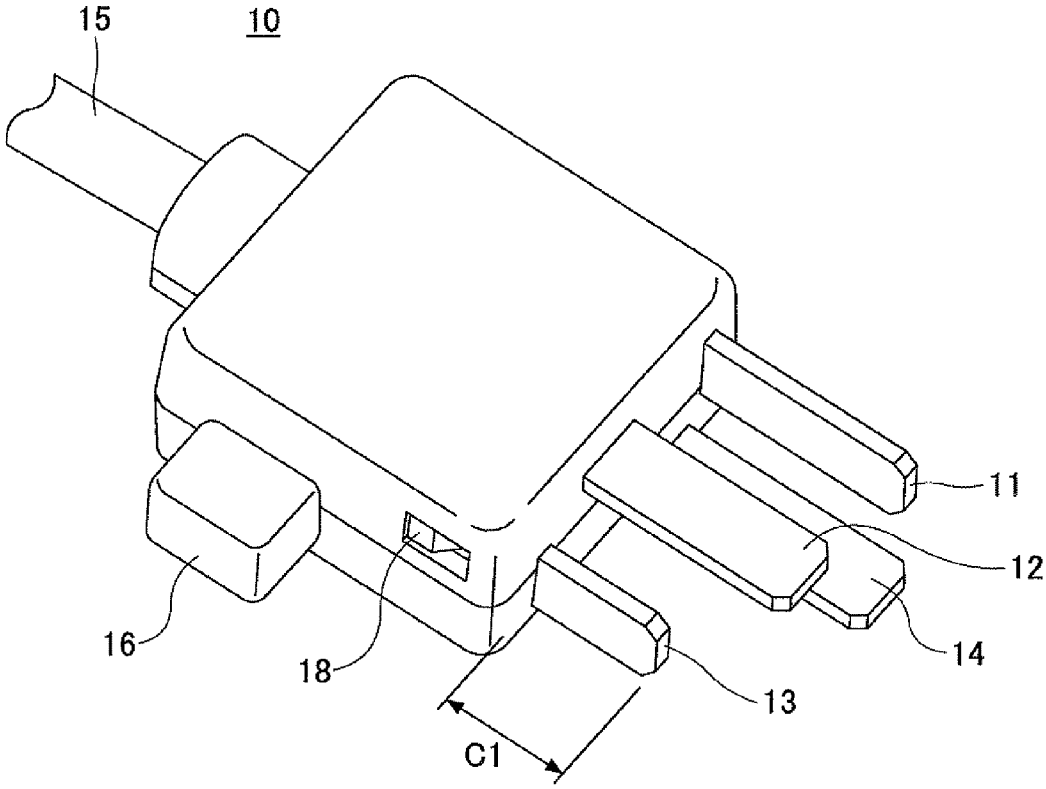
FIG. 13A is a schematic diagram illustrating the outside of the inserting connector in a state where the control plug terminal is in a contracting state according to the first embodiment of the present invention.
Figure 13B:
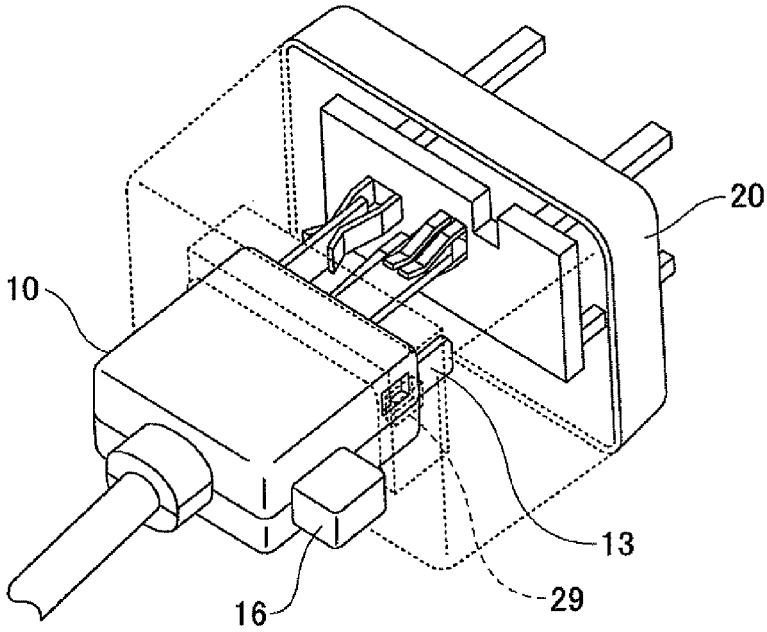
FIG. 13B is a partially transparent perspective view illustrating the inserting connector and the receiving connector in a connected state where the control plug terminal is in a contracting state according to the first embodiment of the present invention.
Figure 14A:
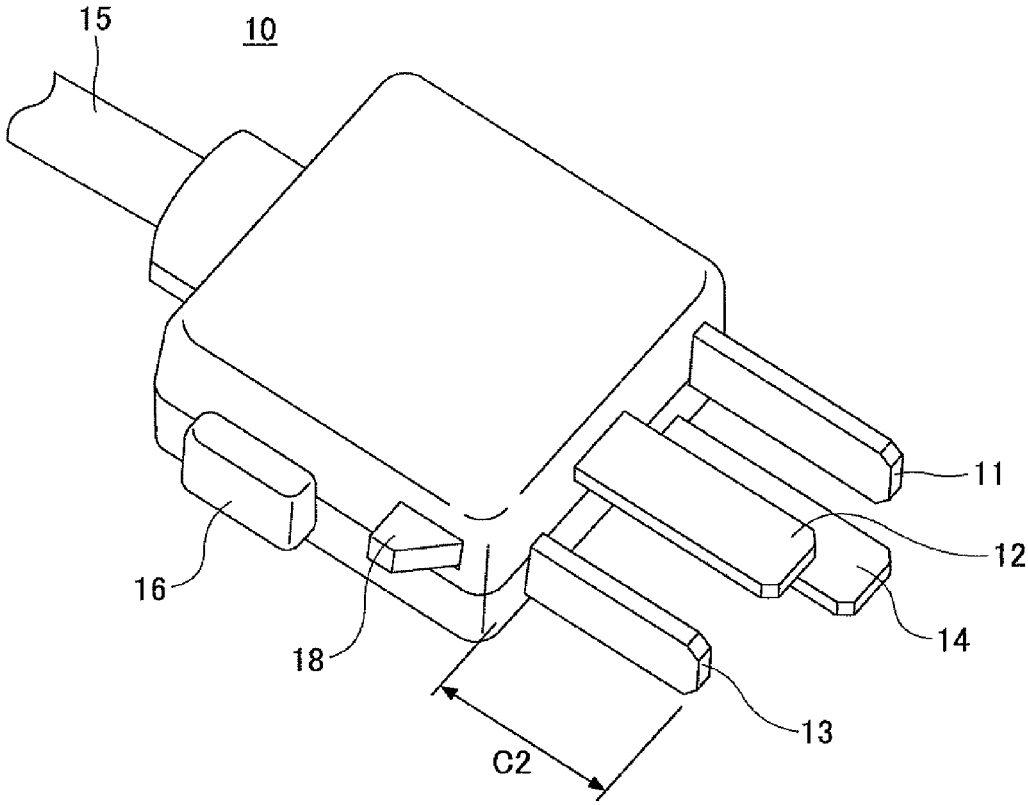
FIG. 14A is a perspective view illustrating the outside of the inserting connector in a state where the control plug terminal is in an extending state according to the first embodiment of the present invention.
Figure 14B:
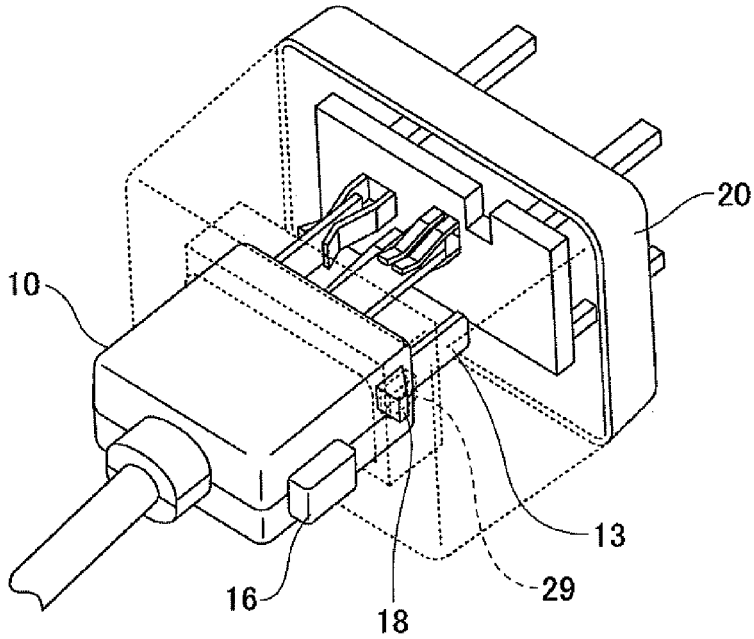

Next, functions of the control plug terminal 13 and the lock terminal 18 are described with reference to FIGS. 13A-14B. FIG. 13A is a schematic diagram illustrating the outside of the inserting connector 10 in a state where the control plug terminal 13 is in a contracting state according to an embodiment of the present invention. FIG. 13B is a partially transparent perspective view illustrating the inserting connector 10 and the receiving connector 20 in a connected state where the control plug terminal 13 is in a contracting state according to an embodiment of the present invention. FIG. 14A is a perspective view illustrating the outside of the inserting connector 10 in a state where the control plug terminal 13 is in an extending state according to an embodiment of the present invention. FIG. 14B is a schematic diagram illustrating an inserting connector 10 in a state where the control plug terminal 13 is in an extending state according to an embodiment of the present invention.

As illustrated in FIG. 13A, the length C1 of the control plug terminal 13 in a contracting state is 10 mm. As illustrated in FIG. 14A, the length of the control plug terminal 13 in an extending state is 14.5 mm.

As illustrated in FIG. 13B, the receiving connector 20 includes a recess part 29 formed at a position corresponding to the lock terminal 18 provided in the inserting connector 10. As illustrated in FIG. 14B, in a state where the lock terminal 18 is in a protruding state, the recess part prevents the engaged inserting connector 10 and the receiving connector 20 from disengaging.

In the above-described embodiment, the press-button 16 causes the control plug terminal 13 to extend/contract along the inserting direction and causes the lock terminal 18 to protrude from the main body 19. As an alternative of the press-button 16, a slide switch or the like capable of moving in the inserting direction may be used to cause the control plug terminal 13 to extend/contract along the inserting direction and cause the lock terminal 18 to protrude from the main body 19.

With the above-described embodiment of the connector apparatus 100, by extending the control plug terminal 13 in a state where the power plug terminals 11, 12 of the inserting connector 10 are engaged to the power jack terminal 21, 22 of the receiving connector 20, electric current can flow through the connector apparatus 100 via the control switches 31, 32 of the control jack terminal 23, and power can be supplied to the data apparatus 40 via the power jack terminals 21, 22 and the power plug terminals 11, 12.

Accordingly, because power can be supplied from the power jack terminals 21, 22 when the control plug terminal 13 is in an extending state, high voltage (e.g., 400 V DC) can be prevented from being applied to the power jack terminals 21, 22 where the inserting connector 10 is not connected to the receiving connector 20. That is, even in a case where a person inadvertently touches the power jack terminals 21, 22 or touches the power jack terminals 21, 22 with a screwdriver, a metal fragment, or a lead wire, the person can be prevented from being injured when high voltage (e.g., 400 V DC) is supplied to the power jack terminals 21, 22 in a state where the inserting connector 10 is not engaged to the receiving connector 20.

(Power Supply System)

Next, a configuration of a power supply system 200 using the connector apparatus 100 according to an embodiment of the present invention is described.

FIG. 15 is a schematic diagram illustrating a configuration of the power supply system 200 using the connector apparatus 100 according to an embodiment of the present invention.

In the power supply system 200 of this embodiment, electric power of AC 100 V or AC 200 V from a commercial power supply 70 is input to the high voltage power source 50 and converted to DC 400 V by a AC/DC converter 51 in the high voltage power source 50. Because DC power can be stored in a battery or the like, a battery 52 is provided in the high voltage power source 50 for a backup purpose. Thereby, the battery 52 can be utilized in a case where a blackout or the like occurs. In this embodiment, the receiving connector 10 is connected to the high voltage power source 50 via a power source cable 15, so that electric power of 400 V DC can be supplied from the high voltage power source 50 to the receiving connector 20.

In this embodiment, the inserting connector 10 is connected to the data apparatus (e.g., server) 40 via the power source cable 50. By electrically connecting the inserting connector 20 and the receiving connector 10, the power from the high voltage power source 50 can be supplied to the data apparatus 40.

In this embodiment, the data apparatus 40 includes a DC/DC converter 41 for converting the high voltage of 400 VDC to a low DC voltage, so that an electronic component such as a CPU (Central Processing Unit) 42 can operate with the low DC voltage.

With the power supply system 200, power loss is little because conversion from AC of the commercial power source 70 to DC is performed only for a single time. Further, with the power supply system 200, there is little need to consider the thickness of the lead wire in a case where the voltage is a high DC voltage of 400 VDC. Because the supplied power is DC, the DC power can be stored in the battery 52 and can be utilized in a case where the supply of power from the commercial power source 70 is stopped (e.g., blackout).

Figure 16:
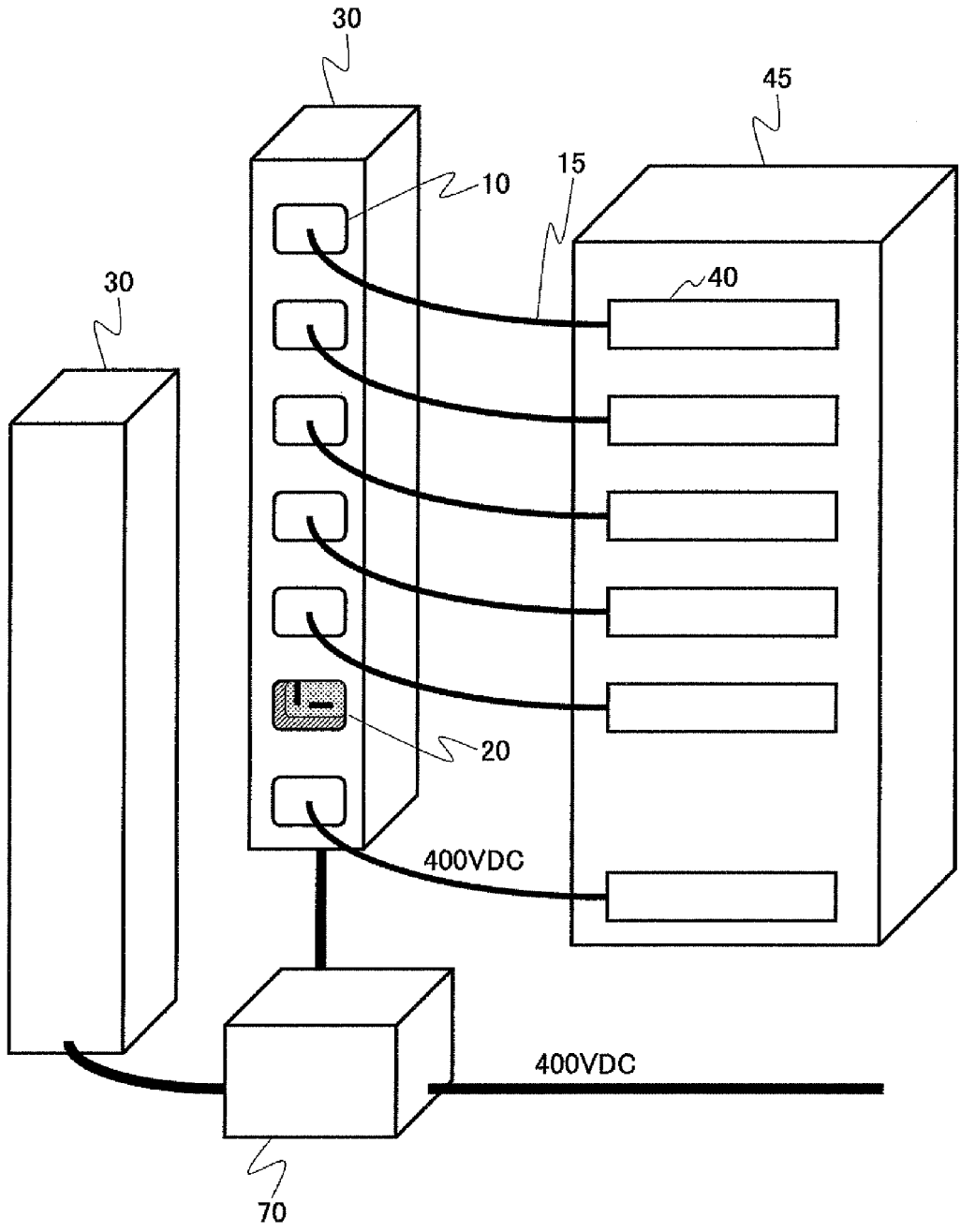

Next, a PDU (Power Distribution Unit) 30 using the connector apparatus 100 according to an embodiment of the present invention is described with reference to FIG. 16.

The 400 VDC power supplied from the high voltage power source 50 is first input to a distribution board 70 and distributed to each of the PDUs 30. Each PDU 30 includes plural receiving connectors 20 for supplying power of 400 VDC via corresponding inserting connectors 10. Plural data apparatuses (e.g., servers) 40 are housed in a server rack 45. Each of the data apparatuses 40 is connected to the inserting connector 10 via the power cable 15 for receiving supply of power. The inserting connector 10 supplies high voltage (in this embodiment, 400 VDC) by connecting the corresponding receiving connector 20 provided in the PDU 30.

Although the power being supplied by the inserting connector 10 and the receiving connector 20 of the connector apparatus 100 is 400 VDC according to the above-described embodiments of the present invention, the power being supplied by the inserting connector 10 and the receiving connector 20 of the connector apparatus 100 is not limited to 400 VDC. The power being supplied may be other values as long as the electric power is DC (Direct Current). DC of other values may be supplied by using the Unlike AC, there is no frequency that is safe for humans.

From the standpoint on the effect on humans, power equal to or less than 48 V is typically used. If the power is equal to or less than 48 V, it is most unlikely that a human will be injured by electrocution. Therefore, in a case where the power is greater than 48 V, the probability of a human to be adversely affected by the power is high (particularly, in a case where the power is equal to or greater than 200 V).

Owing to the enhanced safety of the connector apparatus 100 including the inserting connector 10 and the receiving connector 20 according to the above-described embodiments, significant effects can be attained in a case where the voltage is greater than 48 V (more particularly, equal to or greater than 200 V). That is, because the connector apparatus 100 including the inserting connector 10 and the receiving connector 20 has a configuration different from that of a connector apparatus of a related art example, safety can be enhanced even where the power supply is greater than 48 V (more particularly, equal to or greater than 200 V).

[Second Embodiment]

Next, an inserting connector 110 according to a second embodiment of the present invention is described. With the inserting connector 110, a control plug terminal 113 is extended and contracted by a slide switch 116.

FIG. 17A is a perspective view illustrating the inserting connector 110 where the control plug terminal 113 is in a contracting state. FIG. 17B is a perspective view illustrating the inserting connector 110 where the control plug terminal 113 is in an extending state.

The inserting connector 110 includes a main body (casing) 150, two power plug terminals 111, 112, the control plug terminal 113, a ground plug terminal 114, the slide switch 116, and a lock terminal 108. The ground plug terminal 114 is for earthing.

By sliding the slide switch 116 in the inserting direction of the inserting connector 110, the control plug terminal 113 extends in the inserting direction of the inserting connector 110 and the lock terminal 108 protrudes from the main body 150.

Next, a case of extending the control plug terminal 113 of the inserting connector 110 according to the second embodiment of the present invention is described with reference to FIGS. 18A-19. By extending the control plug terminal 113, the contact points of the control switches in the control jack terminal of the receiving connector (not illustrated) change from an open state to a closed state.

FIG. 18A is a schematic diagram illustrating the inside of the inserting connector 110 where the control plug terminal 113 is in a contracted state. FIG. 18B is a perspective view illustrating the inside of the inserting connector 110 where the control plug terminal 113 is in a contracted state. FIG. 18C is a schematic diagram illustrating the inside of the inserting connector 110 where the control plug terminal 113 is in a neutral state (state in the middle of shifting from the contracting state to the extending state). FIG. 18D is a perspective view illustrating the inside of the inserting connector 110 where the control plug terminal 113 is in a neutral state (state in the middle of shifting from the contracting state to the extending state). FIG. 18E is a schematic diagram illustrating the inside of the inserting connector 110 where the control plug terminal 113 is in an extending state. FIG. 18F is a perspective view illustrating the inside of the inserting connector where the control plug terminal 113 is in an extending state. FIG. 19 is a partial enlarged view illustrating the inserting connector 110 in the state of FIG. 18F.

Inside the inserting connector 110, the slide switch 116 is provided with a U-shaped part 117 for causing the extending of the control plug terminal 113 via the control plug terminal link 118 as illustrated in FIGS. 18A and 18B. Further, inside the inserting connector 110, a coil spring (torsion spring) 119 is provided inside the inserting connector 110. The coil spring 119 has one end 119*a* which is rotatably attached to the main body 150. The coil spring 119 has another end (not illustrated) which is rotatably attached to a cam shaft 121 of the control plug terminal link 118. The cam shaft 121 is movable inside a cam groove 122.

A slide axle 123 is provided in the control plug terminal link 118. The slide axle 123 is movable inside a slide groove 124. A distal end part 125 of the control plug terminal link 118 is inserted in a shock absorption groove 126 formed in the control plug terminal 113. Thereby, the control plug terminal link 118 is movable along the shock absorption groove 126.

In the case where the control plug terminal 113 is in a contracting state, the slide switch 116 and the control plug terminal link 118 are positioned toward the left side as illustrated in FIG. 18A. In FIG. 18A, the cam shaft 121 is positioned at the leftmost part in the cam groove 122 and is in contact with an inner left wall of the U-shaped part 117. In FIG. 18A, the slide axle 123 is positioned at the left side in the slide groove 124. The distal end part 125 of the control plug terminal link 118 is in contact with a left end (step part) of the shock absorption groove 126. In the state where the control plug terminal 113 is contracted, the coil spring 119 is in a slightly closed (bent) state compared to a case where the coil spring 119 is in a natural state.

Then, by sliding the slide switch 116 in an inserting direction (in this example, right side in FIG. 18C), the control plug terminal 113 is moved to a neutral position as illustrated in FIGS. 18C and 18D. In the neutral state, the moving direction of the slide switch 116 is orthogonal to the direction that connects the one end 119*a* and the other end (not illustrated) of the coil spring 119 together.

In the case where the control plug terminal 113 is in the neutral state, the slide switch 116 is positioned substantially at a center part as illustrated in FIG. 18C. In shifting to the neutral state, the cam shaft 121 of the control plug terminal link 118 is pressed toward the right by the inner left wall of the U-shaped part 117 and moved along the cam groove 122. Thereby, the cam shaft 121 becomes positioned substantially at the center part as illustrated in FIG. 18C. In shifting to the neutral state, the distal end part 125 of the control plug terminal link 118 also moves to the right. However, because the distal end part 125 moves in the shock absorption groove 126, the control plug terminal 113 remains in a contracting state. When the control plug terminal 113 is in the neutral state, the coil spring 119 is more closed (bent) compared to the state illustrated in FIGS. 18A and 18B. Thus, the restoring force of the coil spring 119 is greater compared to the state illustrated in FIGS. 18A and 18B.

Then, by sliding the slide switch 116 further in an inserting direction (in this example, right side in FIG. 18E), the control plug terminal 113 is moved to a position as illustrated in FIGS. 18E and 18F.

That is, the restoring force (force of spreading apart) of the coil spring 119 causes the cam shaft 121 to move to the right along the cam groove 122 as illustrated in FIG. 18E. Thereby, the right end of the shock absorption groove 126 is pushed via the distal end part 125 of the control plug terminal link 118. As a result the control plug terminal 113 extends in the inserting direction.

In the case where the control plug terminal 113 is in the extending state, the slide switch 116 is moved to the right side as illustrated in FIG. 18E. In the extending state, the control plug terminal link 118 is also moved to the right side as illustrated in FIG. 18E. Further, in the extending state, the cam shaft 121 is moved to the right-most position in the cam groove 122, so that the cam shaft 121 contacts the inner right wall of the U-shaped part 117. Further, the slide axle 123 of the control plug terminal link 118 is moved to the right along the slide groove 124, so that the distal end part 125 contacts the right end of the shock absorption groove 126. In this extending state, the coil spring 119 is more open (more spread apart) compared to the state during the neutral state.

In the above-described manner, the control plug terminal 113 can be extended in the inserting direction. The extending of the control plug terminal 113 in the inserting direction is achieved by the restoring force of the coil spring 119 generated from the neutral state. That is, the spreading apart force (opening force) of the coil spring 119 enables the control plug terminal 113 to extend in the inserting direction in a short time.

Next, a case of contracting the control plug terminal 113 of the inserting connector 110 according to the second embodiment of the present invention is described with reference to FIGS. 18A-19. By contracting the control plug terminal 113, the contact points of the control switches in the control jack terminal of the receiving connector (not illustrated) change from a closed state to an open state.

In the extending state as illustrated in FIGS. 18E and 18F, the slide switch 116 is positioned at the right side. In the extending state, the control plug terminal link 118 is also positioned at the right side as illustrated in FIG. 18E. Further, in the extending state, the cam shaft 121 is positioned at the right-most position in the cam groove 122, so that the cam shaft 121 is in contact with the inner right wall of the U-shaped part 117. Further, the slide axle 123 of the control plug terminal link 118 is positioned at the right along the slide groove 124, so that the distal end part 125 is in contact with the right end of the shock absorption groove 126. In this extending state, the coil spring 119 is more closed (more bent) compared to the natural state of the coil spring 119.

Then, by sliding the slide switch 116 in a withdrawing direction (in this example, left side in FIG. 18C), the control plug terminal 113 is moved to a neutral position as illustrated in FIGS. 18C and 18D. In the neutral state, the moving direction of the slide switch 116 is orthogonal to the direction that connects the one end 119*a* and the other end (not illustrated) of the coil spring 119 together.

In the case where the control plug terminal 113 is in the neutral state, the slide switch 116 is positioned substantially at a center part as illustrated in FIG. 18C. In shifting to the neutral state, the cam shaft 121 of the control plug terminal link 118 is pressed toward the left by the inner right wall of the U-shaped part 117 and moved along the cam groove 122. Thereby, the cam shaft 121 becomes positioned substantially at the center part as illustrated in FIG. 18C. In shifting to the neutral state, the distal end part 125 of the control plug terminal link 118 also moves to the left. However, because the distal end part 125 moves in the shock absorption groove 126, the control plug terminal 113 remains in an extending state. When the control plug terminal 113 is in the neutral state, the coil spring 119 is more closed (bent) compared to the state illustrated in FIGS. 18E and 18F. Thus, the restoring force of the coil spring 119 is greater compared to the state illustrated in FIGS. 18E and 18F.

Then, by sliding the slide switch 116 further in a withdrawing (pulling) direction (in this example, left side in FIG. 18A), the control plug terminal 113 is moved to a position as illustrated in FIGS. 18A and 18B.

That is, the restoring force (force of spreading apart) of the coil spring 119 causes the cam shaft 121 move to the left along the cam groove 122 as illustrated in FIG. 18A. Thereby, the left end of the shock absorption groove 126 is pushed via the distal end part 125 of the control plug terminal link 118. As a result the control plug terminal 113 contracts in the inserting direction.

In the case where the control plug terminal 113 is in the contracting state, the slide switch 116 is moved to the left side as illustrated in FIG. 18A. In the contracting state, the control plug terminal link 118 is also moved to the left side as illustrated in FIG. 18A. Further, in the contracting state, the cam shaft 121 is moved to the left-most position in the cam groove 122, so that the cam shaft 121 contacts the inner left wall of the U-shaped part 117. Further, the slide axle 123 of the control plug terminal link 118 is moved to the left along the slide groove 124, so that the distal end part 125 contacts the left end of the shock absorption groove 126. In this contracting state, the coil spring 119 is more open (more spread apart) compared to the state during the neutral state.

In the above-described manner, the control plug terminal 113 can be contracted in the withdrawing direction. The contracting of the control plug terminal 113 in the inserting direction is achieved by the restoring force of the coil spring 119 generated from the neutral state. That is, the spreading apart force (opening force) of the coil spring 119 enables the control plug terminal 113 to contract in the inserting direction at a short time.

In a case where no coil spring 119 is provided, the extending and contracting of the control plug terminal 113 in the inserting direction is performed with the fingers of a human. In a case where the extending or contracting the control plug terminal 113 is performed by a human finger without the coil spring 119, the speed of the extending and contracting the control plug terminal 113 may vary and could be slow.

In a case where the extending and contracting is slow, problems such as generation of electric arc or generation of chattering may occur at the contact points of the receiving connector (not illustrated) connected by the control plug terminal 113. The generation of an electric arc or the generation of chattering may damage the contact points of the receiving connector and also damage the data apparatus connected to the inserting connector 110.

The average movement speed of the control plug terminal 113 may be appropriately set in correspondence with, for example, the type or configuration of the control switch of the receiving connector (not illustrated). It is, however, preferred to be equal to or greater than 3 mm/sec.

In the above-described embodiments, the control plug terminal 113 is extended and contracted by utilizing the restoring force of the coil spring 119 (i.e. force of transferring from a closed state (bent state) to an open state (spread apart state)). Alternatively, the control plug terminal 113 is extended and contracted by utilizing an opposite restoring force of the coil spring 119 (i.e. force of transferring from an opened state (spread apart state) to a closed state (bent state) by changing, for example, the cam groove 122. Although the coil spring 119 is used in the above-described embodiments, other elastic components capable of attaining the same effects may alternatively be used.

It is to be noted that the inserting connector 110 of the second embodiment may be used as an alternative of the inserting connector 10 of the first embodiment of the present invention. Thus, by combining the inserting connector 110 of the second embodiment with the receiving connector 20 of the first embodiment, the combination could be used as the connector apparatus 100.

[Third Embodiment]

Next, a connector apparatus 300, an inserting connector 10, and a receiving connector 220 according to a third embodiment of the present invention are described. FIG. 20 is a schematic diagram illustrating the connector apparatus 300, the inserting connector 10, and the receiving connector 220 according to the third embodiment of the present invention. It is to be noted that, in the third embodiment, like components are denoted with like reference numerals as those of the above-described embodiments illustrated in FIGS. 1-16 and further explanation thereof is omitted.

The connector apparatus 300 according to the third embodiment includes the inserting connector 10 and the receiving connector 220. The receiving connector 220 is connected to the high voltage power source 50. The receiving connector 220 includes power jack terminals 21, 22 corresponding to the power plug terminals 11, 12, the control jack terminal 23 corresponding to the control plug terminal 13, and the ground jack terminal 24 corresponding to the ground plug terminal 14.

The receiving connector 220 has a relay 221 including a single coil 222 and two relay contact points 223, 224. By allowing current to flow through the coil 222, the relay contact points 223, 224 close, so that the relay contact points 223, 224 connect to each other. In a case where no current flows through the coil 222, the relay contact points 223, 224 are open and are not connected to each other.

One end of the relay contact point 223 is connected to the positive output of the high voltage power source 50. The other end of the relay contact point 223 is connected to the power jack terminal 21. One end of the relay contact point 224 is connected to the negative output of the high voltage power source 50. The other end of the relay contact point 224 is connected to the power jack terminal 22.

The receiving connector 220 has a relay power source 60 for driving the relay 221. That is, one terminal of the coil 222 is connected to one terminal of the relay power source 60, and the other terminal of the coil 222 and the other terminal of the relay power source 60 are each connected to a control switch 227.

In a state where the inserting connector 10 and the receiving connector 220 are engaged, the control switch 227 establishes electric connection between the inserting connector 10 and the receiving connector 220 by pressing the control plug terminal 13 in the inserting direction.

By the electric connection established by the control switch 27, current from the relay power source 60 flows through the coil 222. Thereby, the relay contact points 223, 224 become closed, so that power is supplied to the power jack terminals 21, 22 of the receiving connector 220. Further, power is supplied to the data apparatus (e.g., server) 40 via the power plug terminals 11, 12 of the inserting connector 10.

The connector apparatus 300 of the third embodiment has a configuration in which the relay contact points 223, 224 are connected to corresponding power jack terminals 21, 22. In a case where a high voltage direct current greater than 48 V (moreover, no less than 200 V) is supplied, the supply of power to the power jack terminal 21, 22 can be controlled owing to the configuration having the relay contact points 223, 224 connected to both power jack terminals 21, 22. Accordingly, even in a case where high voltage (extremely dangerous if human contact is made) is supplied, greater safety can be attained by controlling the supply of high voltage with both power jack terminals 21, 22.

Although the relay 221 is provided inside the receiving connector 220 according to the third embodiment, the relay 221 may be provided to the outside of the receiving connector 220.

FIGS. 21A-21C illustrate the inside of the receiving connector 220 according to the third embodiment of the present invention. It is to be noted that, in FIGS. 21A-21C, like components are denoted with like reference numerals as those of the embodiment illustrated in FIGS. 1-16.

The receiving connector 220 includes the power jack terminals 21, 22 and the ground jack terminal 24. The control switch 227 is provided at a part of the control jack terminal 23. The control jack terminal 23 is positioned in correspondence with the control plug terminal 13. The control switch 227 can be switched on/off via an insulative leaf spring 33. The control switch 227 has a first leaf spring shaped switch 227*a* including contact points 36, 37 and a second leaf spring shaped switch 227*b* including contact points 38, 39. In order to prevent generation of electric arc, the permanent magnet 25A is provided in the vicinity of the contact points 36, 37, and the permanent magnet 25B is provided in the vicinity of the contact points 38, 39. The contact point 37 and the contact point 39 are electrically connected. The contact point 36 is connected to the relay power source 60 illustrated in FIG. 20. The contact point 38 is connected to the coil 222 of the relay 221 illustrated in FIG. 20.

In a case where the control plug terminal 13 of the inserting connector 10 is in an extending state, the insulative leaf spring 33 is configured to resiliently deform (bend) to cause the contact points 36, 37 of the first leaf spring shaped switch 227*a* to contact and concurrently cause the contact points 38, 39 of the second leaf spring shaped switch 227*b* to contact. Thereby, the contact point 36 and the contact point 28 become electrically connected. Thereby, power is supplied from the relay power source 60, current flows through the coil 222 of the relay 221, the relay contact points 223, 224 become connected, and power is supplied from the high voltage power source 50 via the power jack terminals 21, 22.

It is to be noted that the connector apparatus 300 of this embodiment may be used for the power supply system 200 described in the first embodiment.

[Fourth Embodiment]

Next, a connector apparatus 400, the inserting connector 10, and a receiving connector 320 according to a fourth embodiment of the present invention are described. FIG. 22 is a schematic diagram illustrating the connector apparatus 400, the inserting connector 10, and the receiving connector 320 according to the fourth embodiment of the present invention. It is to be noted that, in the fourth embodiment, like components are denoted with like reference numerals as those of the above-described embodiments illustrated in FIGS. 1-16 and further explanation thereof is omitted. Because the inside configuration of the receiving connector 320 is substantially the same as that of the receiving connector 220 illustrated in FIGS. 21A-21C, further description and illustration of the inside of the receiving connector 320 are omitted.

The connector apparatus 400 according to the fourth embodiment includes the inserting connector 10 and the receiving connector 320. The receiving connector 320 is connected to the high voltage power source 50 for supplying electric power. The receiving connector 320 includes the power jack terminals 21, 22 corresponding to the power plug terminals 11, 12, the control jack terminal 23 corresponding to the control plug terminal 13, and the ground jack terminal 24 corresponding to the ground plug terminal 14.

The receiving connector 320 includes two relays 321, 322. The relay 321 includes a coil 323 and a relay contact point 324 that closes and connects when current flows through the coil 323. In a case where current does not flow in the coil 323, the relay contact point 324 becomes open and disconnected. The relay 322 includes a coil 325, and a relay contact point 326 that closes and connects when current flows through the coil 325. In a case where current does not flow in the coil 325, the relay contact point 326 becomes open and disconnected.

One end of the relay contact point 324 is connected to the positive output of the high voltage power source 50 and the other end of the relay contact point 324 is connected to power jack terminal 21. Further, one end of the relay contact point 326 is connected to the negative output of the high voltage power source 50 and the other end of the relay contact point 326 is connected to the power jack terminal 22.

The receiving connector 320 is connected to the relay power source 60 for driving the relays 321, 322. More specifically, one terminal of the coil 323 of the relay 321 and one end of the coil 325 of the relay 321 are connected, so that the coil 323 of the relay 321 and the coil 325 of the relay 322 are connected in series. The other terminal of the coil 323 and one terminal of the relay power source 60 are connected. Further, the other terminal of the coil 325 and the other terminal of the relay power source 60 are each connected to the control switch 227.

In a case where the inserting connector 10 and the receiving connector 320 are in an engaged state, the contact points (not illustrated) of the control switch 227 become connected by pressing the control plug terminal 13 of the inserting connector 10 in the inserting direction.

Accordingly, by connecting the contact points of the control switch 227, current from the relay power source 60 flows through the coils 323, 325, the relay contact points 324, 326 become closed, power is supplied to the power jack terminals 21, 22 of the receiving connector 320, and power is supplied to the data device (e.g., server) 40 via the power plug terminals 11, 12 of the inserting connector 320.

The connector apparatus 400 of the fourth embodiment has a configuration in which the relay contact points 324, 326 of the relays 321, 322 are connected to corresponding power jack terminals 21, 22. In a case where a high voltage direct current greater than 48 V (moreover, no less than 200 V) is supplied, the supply of power to the power jack terminal 21, 22 can be controlled owing to the configuration having the relay contact points 324, 326 connected to both power jack terminals 21, 22. Accordingly, even in a case where high voltage (extremely dangerous if human contact is made) is supplied, greater safety can be attained by controlling the supply of high voltage with both power jack terminals 21, 22.

Although the relays 321, 322 are provided inside the receiving connector 320 according to the fourth embodiment, the relays 321, 322 may be provided to the outside of the receiving connector 320.

It is to be noted that the connector apparatus 400 of this embodiment may be used for the power supply system 200 described in the first embodiment.

Further, the present invention is not limited to these embodiments, but variations and modifications may be made without departing from the scope of the present invention. The present application is based on Japanese Priority Application No. 2009-259775 filed on Nov. 13, 2009, with the Japanese Patent Office, the entire contents of which are hereby incorporated by reference.

What is claimed is

1. A connector apparatus comprising:

a receiving connector connected to a power source and including first and second power jack terminals, a control jack terminal, a control switch including first and second contact points, and an insulative spring positioned below the control switch; and an inserting connector connected to an electronic device and including first and second power plug terminals connected in correspondence with the first and second power jack terminals for receiving power from the power source, and a control plug terminal that extends towards the control switch and applies pressure to the insulative spring for causing the first and second contact points to connect and enabling the power from the power source to be supplied to the electronic device;

wherein a part of the insulative spring is configured to melt when an electric arc is generated by disconnecting the connection between the first and second contact points;

wherein the part of the insulative spring protrudes toward the control switch.

2. The connector apparatus as claimed in claim 1, wherein the control plug terminal includes an engagement hole part, wherein the receiving connector further includes a pair of arms that flex in correspondence with the extending of the control plug terminal in a direction orthogonal to the extending direction of the control plug terminal.

3. The connector apparatus as claimed in claim 1, wherein the extending of the control plug terminal is conducted by at least one of a slide switch and a press-button switch.

4. The connector apparatus as claimed in claim 1, further comprising:

a coil spring having first and second ends; and a slide switch that moves in a direction orthogonal to a direction that connects the first end and the second end of the coil spring;

wherein the coil spring is configured to bend in correspondence with the movement of the slide switch.

5. The connector apparatus as claimed in claim 4, wherein the coil spring is in a bent state when the control plug terminal is in a neutral position, wherein a restoring force of the coil spring causes the control plug terminal to extend in the extending direction.

6. The connector apparatus as claimed in claim 4, wherein a restoring force of the coil spring causes the control plug terminal to contract in the extending direction.

7. The connector apparatus as claimed in claim 1, wherein the inserting connector further includes a ground plug terminal, wherein the receiving connector further includes a ground jack terminal connected in correspondence with the ground plug terminal when the receiving connector and the inserting connector are in an engaged state.

8. The connector apparatus as claimed in claim 1, wherein the power source is configured to supply power of a direct current.

9. The connector apparatus as claimed in claim 1, wherein the power source is configured to supply power having a voltage greater than 48 V.

10. A receiving connector connected to a power source for supplying power to an electronic device via an inserting connector, the receiving connector comprising:

first and second power jack terminals;

a control jack terminal to which a control plug terminal of the inserting connector is inserted;

a control switch including first and second contact points; and an insulative spring positioned below the control switch;

wherein the control plug terminal is configured to extend towards the control jack terminal and apply pressure to the insulative spring for causing the first and second contact points to connect and enabling the power from the power source to be supplied to the electronic device;

wherein a part of the insulative spring is configured to melt when an electric arc is generated by disconnecting the connection between the first and second contact points;

wherein the part of the insulative spring protrudes toward the control switch.

11. The receiving connector as claimed in claim 10, wherein the control plug terminal includes an engagement hole part, wherein the receiving connector further includes a pair of arms that flex in correspondence with the extending of the control plug terminal in a direction orthogonal to the extending direction of the control plug terminal.

12. The receiving connector as claimed in claim 10, wherein the inserting connector further includes a ground plug terminal, wherein the receiving connector further includes a ground jack terminal connected in correspondence with the ground plug terminal when the receiving connector and the inserting connector are in an engaged state.

13. The receiving connector as claimed in claim 10, further comprising:

a coil spring having first and second ends; and a slide switch that moves in a direction orthogonal to a direction that connects the first end and the second end of the coil spring;

wherein the coil spring is configured to bend in correspondence with the movement of the slide switch.

14. The receiving connector as claimed in claim 10, wherein the power source is configured to supply power of a direct current.

15. The receiving connector as claimed in claim 10, wherein the power source is configured to supply power having a voltage greater than 48 V.

* * * * *

UNITED STATES PATENT AND TRADEMARK OFFICE

CERTIFICATE OF CORRECTION

PATENT NO. : 8,133,066 B2
APPLICATION NO. : 12/842241
DATED : March 13, 2012
INVENTOR(S) : Seung Seok Beak et al.

It is certified that error appears in the above-identified patent and that said Letters Patent is hereby corrected as shown below:

Cover Page:

Item 75
Please correct the second inventor's residence as "Shimotakai-gun (JP)" which is incorrectly listed as "Shimotaki-gun (JP)".

Item 73
Please correct the second assignee's company name as "NTT Facilities, Inc." which is incorrectly listed as "NIT Facilities, Inc.".

Signed and Sealed this
Eighth Day of May, 2012

David J. Kappos

David J. Kappos
*Director of the United States Patent and Trademark Office*